US010596066B2

(12) United States Patent
Wagner et al.

(10) Patent No.: US 10,596,066 B2
(45) Date of Patent: Mar. 24, 2020

(54) PACKAGE COMPRISING MEANS FOR OPENING BLISTERS

(71) Applicant: Medcomb Holding APS, Copenhagen V (DK)

(72) Inventors: John Wagner, Værløse (DK); Flemming Wagner, Frederiksberg C (DK)

(73) Assignee: Medcomb Holding APS, Copenhagen V (DK)

( * ) Notice: Subject to any disclaimer, the term of this patent is extended or adjusted under 35 U.S.C. 154(b) by 0 days.

(21) Appl. No.: 15/118,300

(22) PCT Filed: Feb. 10, 2015

(86) PCT No.: PCT/DK2015/050028

§ 371 (c)(1),
(2) Date: Aug. 11, 2016

(87) PCT Pub. No.: WO2015/120857

PCT Pub. Date: Aug. 20, 2015

(65) Prior Publication Data

US 2017/0172846 A1 Jun. 22, 2017

(30) Foreign Application Priority Data

Feb. 11, 2014 (DK) ..... 2014 70067

(51) Int. Cl.
*A61J 1/03* (2006.01)
*B65D 75/32* (2006.01)
(Continued)

(52) U.S. Cl.
CPC ..... *A61J 1/035* (2013.01); *A61J 1/16* (2013.01); *B65D 75/323* (2013.01);
(Continued)

(58) Field of Classification Search
CPC ..... B65D 75/327; B65D 75/367; B65D 83/0445; B65D 83/0463; B65D 83/04;
(Continued)

(56) References Cited

U.S. PATENT DOCUMENTS 4,905,866 A * 3/1990 Bartell ..... B65D 83/0463 206/531
5,356,010 A 10/1994 Weinstein
(Continued)

FOREIGN PATENT DOCUMENTS

WO WO 03/070598 A1 8/2003

OTHER PUBLICATIONS

International Search Report for PCT/DK2015/050028 dated Jul. 21, 2015.

*Primary Examiner* — Anthony D Stashick
*Assistant Examiner* — Onekki P Jolly
(74) *Attorney, Agent, or Firm* — Knobbe Martens Olson & Bear, LLP

(57) ABSTRACT

The present invention relates to a package (7) for pharmaceutical blister packs (12) comprising means (11) for removing the protecting foil of the blister packs. The package protects the blister packs (12) and at the same time provides an easy and convenient way of opening the blister pack for people at all level of ability and dexterity.

15 Claims, 21 Drawing Sheets

(51) Int. Cl.
*B65D 83/04* (2006.01)
*A61J 1/16* (2006.01)

(52) U.S. Cl.
CPC ..... *B65D 75/327* (2013.01); *B65D 83/0463* (2013.01); *B65D 2215/06* (2013.01)

(58) Field of Classification Search
CPC ..... B65D 45/16; B65D 50/046; B65D 1/24; B65D 1/36; B65D 25/04; B65D 43/16; B65D 43/164; B65D 75/325; B65D 75/36; A61J 1/035
USPC ..... 206/538, 532, 528, 531, 1.5; 220/324, 220/281, 50, 836, 810
See application file for complete search history.

(56) References Cited

U.S. PATENT DOCUMENTS 5,431,283 A * 7/1995 Weinstein ..... B65D 5/42 206/469
5,472,115 A * 12/1995 Whiton ..... B65B 69/0058 221/25
5,791,513 A * 8/1998 Intini ..... B65B 69/0058 221/30
6,206,233 B1 * 3/2001 Schulze ..... B65B 69/0058 221/25
D444,361 S * 7/2001 Schulze ..... D8/51
6,557,740 B1 * 5/2003 Dent ..... B65B 69/0058 206/532
D517,884 S * 3/2006 Ellingwood ..... D24/133
D533,661 S * 12/2006 Yip ..... D24/133
7,264,137 B2 * 9/2007 Drought ..... B65D 83/0463 221/25
7,562,790 B2 * 7/2009 Wheeler ..... A61J 7/0007 206/538
7,891,100 B2 * 2/2011 Gelardi ..... B65D 77/24 30/124
7,946,449 B2 * 5/2011 Benktzon ..... A61J 1/035 221/25
2005/0077203 A1 4/2005 Morita et al.
2006/0005398 A1 * 1/2006 Sramek ..... B65B 69/0058 30/278
2006/0289328 A1 12/2006 Hession
2009/0139894 A1 6/2009 Bitner

* cited by examiner

PACKAGE COMPRISING MEANS FOR OPENING BLISTERS

CROSS REFERENCE TO RELATED APPLICATIONS

This application is a U.S. National Phase Application of PCT International Application Number PCT/DK2015/050028, filed on Feb. 10, 2015, designating the United States of America and published in the English language, which is an International Application of and claims the benefit of priority to Danish Patent Application No. PA 2014 70067, filed on Feb. 11, 2014. The disclosures of the above-referenced applications are hereby expressly incorporated by reference in their entireties.

FIELD OF THE INVENTION

The present invention relates to a package for pharmaceutical blister packs. The present invention also relates to a method for opening a package for pharmaceutical blister packs and a method for opening blisters of pharmaceutical blister packs.

BACKGROUND OF THE INVENTION

Solid pharmaceutical compositions such as tablets and capsules are often contained for dispensing in pharmaceutical blister packs. Generally a blister pack comprises a moulded plastic sheet having one or more depressions each defining a blister chamber or cavity, typically for containing a tablet or capsule; these depressions are commonly referred to as "blisters". This plastic sheet is generally covered by a thin layer of foil, also referred to as "protecting foil", for sealing the tablets or capsules within the blisters.

Pharmaceutical blister packs are generally push-through packs. Pressing on a blister causes the tablet or capsule contained in that blister to penetrate the foil layer so that it can easily be removed from the package. The blister from which the tablet is removed is left deformed, and the foil is torn in the region below the blister, but the other blisters remain intact. Blister packages are usually further packed in a paper box together with a leaflet containing information about the medication.

For example, US 2005/0077203 relates to a press through blister package (PTP) case with one or more pills therein. The PTP case includes foldable members to accommodate the blisters.

Standard PTP protecting foil may be very thin to allow rupture upon pressure.

However, this may lead to undesired rupture during transport.

In order to avoid undesired rupture PTP case may have reinforced protective foil.

However, several studies have highlighted the issue that older adults have problems in opening pharmaceutical blister packs having different opening than standard PTP.

An alternative solution for packing tablets is described in US 2006/289328. This document discloses a foldable package including a blank having a face panel and a back panel, where a blister pack is sealed between them. In this way the blisters are aligned over gates and protrude through apertures and tabs and form a composite pull tab. To remove an item from a blister, the pull tab is pressed out of the panels, the tab strip is peeled from the back panel, and pressure is applied to force the item through the backing sheet of the blister pack and the exposed gate.

However, other studies demonstrated also that elderly people have great difficulties in opening blister packs having peel-open features.

A common trait of the elderly population is decreased hand strength and dexterity. Decreased hand strength is a result of declining skeletal muscle mass (40% decrease between ages 50-80) and central command fatigue. This is a condition which advances as people age. Additionally, the elderly population have a high consumption of tablets and pills which come in a variety of different packages. Due to decreased hand strength and dexterity, these blister packages are generally hard for the elderly to open.

The decreased hand strength exhibited by elderly patients can lead to difficulty in carrying out everyday tasks. Furthermore, the reduced dexterity of the elderly populations limits there capability of handling the tablets removed from the pharmaceutical blister pack.

Thus, there is a need for a device that makes the process of opening pharmaceutical blister packs easier for the elderly population and reduces strains on users' joints.

Hence, an improved package which makes the process of opening pharmaceutical blister packs easier for the elderly population would be advantageous and in particular an improved package having the ability of removing the pharmaceutical composition from a pharmaceutical blister pack and hold the pharmaceutical composition would be advantageous as it would reduce the difficulties for the elderly population to take care of their daily compliance to a pharmaceutical treatment.

OBJECT OF THE INVENTION

It is an object of the invention to provide a package for pharmaceutical blister packs containing pharmaceutical compositions where the pharmaceutical compositions contained are protected against undesired rupture of the pharmaceutical blister pack while opening of the pharmaceutical blister pack is still easy and convenient for people of all level of ability and dexterity.

It is a further object of the invention to provide a device which makes the process of opening pharmaceutical blister packs pills easier for the elderly population.

Another object of the invention may be seen as to provide a package for pharmaceutical compositions and a device that can increase the capability in elderly population of handling the pharmaceutical compositions removed from pharmaceutical blister packs.

A further object of the present invention may be seen as to provide a child-resistant package that can be easily opened by one who has been given instructions on how to do so, but cannot be opened by the uninstructed child.

It is a further object of the present invention to provide an alternative to the prior art.

In particular, it may be seen as an object of the present invention to provide a package for pharmaceutical blister packs that solves the above mentioned problems of the prior art by comprising means for removing the pharmaceutical compositions contained in the pharmaceutical blister packs.

SUMMARY OF THE INVENTION

Thus, the above described object and several other objects are intended to be obtained in a first aspect of the invention by providing a package for carrying at least one pharmaceutical blister pack comprising a protecting foil, the package comprising means for removing the protecting foil.

Pharmaceutical blister packs may be several types of pre-formed plastic packaging used for pharmaceuticals.

The words medical package, blister pack and blister package are all used interchangeably in the following description in relation to the invention.

The primary component of a pharmaceutical blister pack is a cavity or pocket made from a formable web, usually a thermoformed plastic. The protecting foil may be a lidding seal, e.g. aluminium, plastic or paper foil, and has the function of sealing and protecting the pharmaceutical compositions, such as tablets or capsules, located inside the blisters or cavities of the blister pack.

The package of the invention by comprising means for removing the protecting foil improves the properties of the package from a package having a simple and effective way of protecting pharmaceutical blister packs into package having de-blistering capability, e.g. a de-blistering tool or a tablet or pill removal device.

Thus, the means for removing the protecting foil may be any means capable of producing a rupture of the protecting foil with the aim of removing and eventually holding the pharmaceutical composition contained in the pharmaceutical blister pack.

The invention has the advantage of reducing the strength and dexterity required to open pharmaceutical blister packs. Furthermore the invention provide a versatile tool applicable to a variety of pill packages including both punch out and peel away packaging in a variety of shapes and sizes and where the pharmaceutical composition remain unharmed in the process of removal.

In some embodiments the means for removing the protecting foil is adapted to hold the pharmaceutical compositions.

The removal of the protecting foil allows for direct access to the pharmaceutical compositions, such as solid pharmaceutical compositions, e.g. tablets, capsules or pills contained in the blisters of the pharmaceutical blister packs.

As mentioned above the reduced dexterity of the elderly populations limits there capability of handling the tablets removed from the pharmaceutical blister pack.

The package of the invention thus has the further advantage of allowing for easier removal of the protecting foil and at the same time of holding the tablets contained in the blisters of the blister pharmaceutical blister pack.

Thus, the means for removing said protecting foil may be also adapted to remove and hold the pharmaceutical composition contained in the blisters of the pharmaceutical blister packs.

The package of the invention thus provides a device which makes the process of opening blister packaged pills easier for the elderly population and the disabled patients with decreased hand strength. The device provided is ideal for home use by the patient, and does not require assistance to use. The device was tested using a variety of over the counter pills showing a high degree of efficiency blisters opening on the first try with none or only minimal damage to the pills.

In some embodiments the package is a plastic package, such as a plastic container or receptacle for permanent use as storage, or for temporary use, e.g. for transporting pharmaceutical compositions.

Other materials alone or in combination with plastic may be used to produce the package.

The package has size suitable for containing at least one pharmaceutical blister pack. For example the package may contain 2, 3, 4, 5 or more pharmaceutical blister packs.

A pharmaceutical composition herein referred may comprise any biologically-active substance, without limitation, for example vitamins essential fatty acids, folic acid, chemical elements, minerals, biologically-active substances, and combinations and derivatives thereof, without limitation. Non-limiting exemplary derivatives of vitamin compounds include salts, alkaline salts, esters and chelates of any vitamin compound.

Pharmaceutical composition may be prescription or non-prescription substances or excipients for use in prescription or non-prescription substances.

Non-prescription substances can be a vitamin or derivative thereof, or a mineral compound or derivative thereof. Derivatives of vitamin compounds include salts, alkaline salts, esters and chelates of any vitamin compound, without limitation.

The non-prescription substances can also be a herbal compound, herbal extract, derivative thereof or combinations thereof, without limitation.

Pharmaceutical composition herein referred may take any form, and combinations thereof. Examples of such forms include, without limitation, chewable tablet, quick dissolve tablet, effervescent tablet, reconstitute powder, elixir, tablet, multi-layer tablet, bi-layer tablet, capsule, soft gelatine capsule, hard gelatine capsule, caplet, lozenge, chewable lozenge, bead, cachets, suppository, patch, food, nutritive food, functional food, yogurt, gelatine, cereal, cereal coating, animal feed or combinations thereof. The preparation of any of the above forms may be performed by techniques and methods well known and readily available to persons of ordinary skill in the art.

In some embodiments the pharmaceutical blister packs, may be medical blister trays containing medical tools, accessories or devices. In this case the means for removing said protecting foil may be adapted to hold medical tools, accessories or devices contained in the medical blister trays.

The package may comprise a container having an internal and external surface.

In some embodiments the at least one pharmaceutical blister pack is contained inside the container.

The means for removing the protecting foil may be located on a surface of the package.

For example the means for removing the protecting foil may be located on the internal or the external surface of the container.

In some embodiments the means for removing the protecting foil is or comprises a protrusion extending out of a surface of the package.

For example the surface may be a surface of the container.

The protrusion may have a shape and size that allows the rupture of the protecting foil when put in contact with the protecting foil.

The protrusion may also have a shape and size that allows for removal of the pharmaceutical composition contained in the pharmaceutical blister pack.

Furthermore the protrusion may also have a shape and size that allows for holding the pharmaceutical composition removed from the pharmaceutical blister pack.

For example the protrusion may be a circular, an oval, a sinusoidal, a drop shape, a half open rim or a closed rim protrusion.

In some embodiments the protrusion has at least an indentation.

Indentation is defined as the presence of cuts, such as concave cut, into an edge of the protrusion with tooth-like notches or angular incisions.

Indentation may also be defined as small pits on the edge of a surface.

Indentation may have the advantage of providing an easier rupture/better shredding of the protecting foil. Indentations may also provide an improved way of holding the pharmaceutical compositions removed from the pharmaceutical blister pack.

In some embodiments the package further comprises a lid. For example the container comprised in the package may comprise the lid.

The lid may be connected to the container. For example the lid may be pivotally connected to the container.

Pivotally is herein defined as connected in a pivotal manner, e.g. by means of or on a pivot so that it can be turned around or along a pivot such a specific point, axes or edge, e.g. a fold line on the container.

In some embodiments the lid may be hinged to the container.

In some embodiments the lid is hingedly connected to a hinge element that is in turn hingedly connected to the container.

The package may be produced by means of injection moulding techniques. For example, the container may be obtainable by injection moulding techniques.

In some embodiments the container and the lid are obtainable by injection moulding techniques produced as parts of a single product.

In some further embodiments the container, the lid and the protrusion are obtainable by injection moulding techniques and produced as parts of a single product.

However, other methods may be used for producing the package of the invention, such as thermoforming or additive manufacturing.

The package is provided with opening means.

In some embodiments the protrusion is provided on the peripheral outer surface of the package.

The peripheral outer surface of the package is defined as the peripheric part of the outer, i.e. external surface of the package, where peripheric is defined as the part of the package which is the most far from the opening means. This location is advantageous as situated far from the opening of the package and thus does not interfere with the opening means.

In some other embodiments the protrusion has a lateral and a vertical extent and the lateral extent is larger than the vertical extent.

In some further embodiments the protrusion has a lateral and a vertical extent and the lateral extent is larger than the vertical extent. This specific configuration has the advantage of improving the capability of holding the pharmaceutical composition removed from the pharmaceutical blister pack.

In some embodiments the protrusion has a radial extent smaller than a blister of the at least one blister pack contained in the package.

In this way by putting in contact the protrusion with the protecting foil and applying pressure onto the blister pack, following the rupture of the protecting foil the protrusion can penetrate into the cavity of the blister pack, i.e. with no hindrance due to the side walls of the cavity.

In some embodiments the radial extent is larger than or equal to the pharmaceutical composition contained in the blister or cavity of the blister pack. In this way, once the protrusion penetrates into the cavity of the blister pack, the pharmaceutical composition can be easily removed from the cavity and held by or in the protrusion present on the surface of the package.

The protrusion may be of any suitable size and/or shape that allow removal, grip and temporary storage of the pharmaceutical composition contained in the cavities of the blister packs.

The radial extent of the protrusion may match the dimensions, e.g. the diameter of the pharmaceutical composition contained in the cavities of the blister packs. In some embodiments the protrusion is a single continuous protrusion.

In some other embodiment the protrusion is two or more separate protrusions.

The protrusion and the container may be made of the same kind of material.

In some embodiments the protrusion comprises other material than the one of the container.

The means for removing the protecting foil may be fastened to or included in the container.

The means for removing the protecting foil may be produced separately from the package and/or fastened to the external or internal surface of the package, e.g. glued to the container.

The means for removing the protecting foil may not be part of the package and may be added, e.g. included in the container, at a later stage.

In some embodiments the package further comprises means for detecting tampering of the package.

Means for detecting tampering comply with the raising need of tamper proof packaging.

Means for detecting tampering are for example tamper resistance means.

Resistance to tampering, so as to deter package tampering, may be achieved by marking the physical access to the package upon first use. For example, tamper resistance ranges from simple features, such as plastic locks that need to be broken upon opening of the package, e.g. similar to screws with special heads for bottles, to more complex devices where opening of the package may be achieved only by special tools or using specific knowledge.

In some embodiments means for detecting tampering are only tamper-evident rather than tamper-resistant.

In a second aspect of the invention the above described object and several other objects are intended to be obtained by providing a method of opening a pharmaceutical blister pack comprised in a package according to the first aspect of the invention, the method comprising: opening the package; removing the pharmaceutical blister pack; contacting the protrusion to the protecting foil covering a blister of the pharmaceutical blister pack; exerting a pressure on the protrusion thereby removing the foil in correspondence of the blister.

In a third aspect of the invention the above described object and several other objects are intended to be obtained by providing a method of opening a pharmaceutical blister pack comprised in a package according to the first aspect of the invention, the method comprising: opening the package; removing the pharmaceutical blister pack; contacting the protrusion to the protecting foil covering a blister of the pharmaceutical blister pack; exerting a pressure on the blister thereby removing the foil in correspondence of the blister.

In both second and third aspects the opening of the pharmaceutical blister pack may comprise twisting of the contacting protrusion in contact with the protecting foil so as to rip or shred the foil and gain access to the pharmaceutical composition located in the correspondent blister.

The package of the invention may be characterized by the presence of child-resistant means.

Child-resistant means may be any means that hinder a child from opening the package.

In some embodiments the means for opening the package are located at a distance from each other longer than the length between the thumb and one of the four fingers of a child hand when the child hand is open.

For example the distance between the opening means of the package may be in the range between 5 and 30 cm, more preferably in the range between 10 and 25 cm.

A child is not able to open the package of the invention as the correct opening is physically hampered and/or impeded to a child as the child cannot hold the package in his hands and at the same time perform an action on the opening means. Thus, the child-resistant package of the invention may be characterized in that it cannot be hold and/or opened by child hands.

Physically hinder thus refers to the fact that the opening is hindered in relation to physical issues, e.g. in relation to body issues, such as the child hands dimensions.

In some further embodiments the means for opening are at least two. The distance between the two opening means is thus longer than the length between the thumb and one of the four fingers of a child hand when opened.

In some embodiments the means for opening may be at least three located on different side and/or top and/or bottom surface of the package.

The means for opening may comprise pressure means.

For example the pressure means may be buttons, latches, snibs, or locks, such as cam locks.

Thus, in order to open the package the user has to apply pressure onto at least two opposite positions of the package. This is achieved by holding the package on the palm and by using a finger and the opposed thumb to exert pressure onto two opposite positions located on opposite sides of the package. The pressure may be exerted in positions that are the most distant from each other.

These positions may be also located on the top or bottom surfaces of the package. Thus, those positions may be the pressure means. In some embodiments the pressure means are located on those positions.

In some further embodiments those positions or pressure means may be indicated by the presence of gripping elements. Thus, the gripping elements may hide the positions or pressure means. In some embodiments the positions or pressure means on which the user has to apply pressure so as to open the package may be located within a certain distance from the gripping elements or from further gripping elements.

This may have the advantage of misleading eventual attempt to open the package as the child may be tempted to grip the package via the gripping elements causing intentional or unintentional pressure on the gripping elements and not on the pressure means. By locating the pressure means in areas not identified by any gripping element located onto the external surface of the package, the positions on which pressure should be exert in order to open the package are de facto hidden and thus cannot be found unless the user is instructed to do so. In some embodiments the presence of more gripping elements may also mislead eventual attempt to open the package.

In some embodiments the lid and the container comprise members that mutually engage upon folding and/or pressing of the lid and the container onto each other.

Members may be protrusions or depressions having complementary shapes or dimensions. For example members may be buttons, latches, snibs or locks.

In some embodiments the mutual engagement comprises interlocking between the members.

The lid and the container may comprise members that once the lid and the container are folded onto each other may preferably be joined by an interlocking mechanism.

In some further embodiments the mutual engagement comprises interference fit between the members.

The members of the package may be located on external or internal surfaces of the lid and/or container.

In some embodiments the pressure means comprise at least one first element on the lid and at least one second element on the container having structures having complementary curvatures so that at least one first element on the lid is adapted to mutually engage with at least one second element on the container when the lid is folded onto the container.

Curvature refers intuitively to the amount by which a geometric object deviates from being flat.

In some embodiments the at least one first element on the lid has a distal end having an external diameter which is complementary to a proximal end of the at least one second element on the container.

In some further embodiments the at least one first element on the lid has a proximal end having an external diameter which is complementary to a distal end of the at least one second element on the container.

In some embodiments the at least one first element on the lid has a distal end having an external diameter which is complementary to a proximal end of the at least one second element on the container.

The at least one first element on the lid may have a proximal end having an external diameter which is complementary to a distal end of the at least one second element on the container.

In some further embodiments the at least one first element on the lid and the at least one second element on the container have a shape engaging with corresponding terminal ends of the at least one first element on the lid and the at least one second element on the container so as to interlock.

In some embodiments the means for opening comprise magnetic locking means.

The means for opening may comprise at least two magnets or magnetic materials which will snap together upon overlapping of the lid onto the container of the package.

The means for opening may be a key lock system where the lock is a first magnet located on the package and the key is a second magnet provided separated from the package.

In some further embodiments the means of opening comprises digital means for opening the package.

Examples of digital means may be printed electronics circuit allowing for finger print recognition, thus a bio-recognition, of the user.

In some other embodiments digital means may be triggered by remote opening of the package upon signals from a computer or a portal digital assistant, e.g. a smart phone.

Digital opening means may be advantageous as capable of monitoring when a pill or a device is taken out of its packaging.

In some embodiments integration of Radio-frequency identification (RFID) tags, printed electronics circuit and/or ultra-low-power processor into the plastic foil used for construction of the package may provide advantageous digital opening means.

Magnetic locking means and digital means may also control the engagement and disengagement of the members comprised in the lid and container of the package.

In some embodiments the opening means are not intuitive or are counter intuitive, thereby the opening of the package is achievable only upon reading opening instructions.

The above described object and several other objects are intended to be obtained in a fourth aspect of the invention by providing a package further comprising opening means, wherein the opening means are not intuitive or are counter intuitive, thereby the opening of the package is achievable only upon reading opening instructions.

Opening means are not intuitive or are counter intuitive, thus it cannot be understood simply by the appearance of the package the way in which it can be opened.

This package of the invention has thus the advantage of that can be opened by an instructed adult who may have no more strength than the average child. The child who is uninstructed on the opening of the disclosed package will not be able to reach the package contents. The present invention, therefore, may also rely on the superior knowledge of the adult rather than his superior strength.

The opening instructions may be comprised on a surface of the package.

In some embodiments these opening instructions may be printed, embossed, carved, stamped, etched or attached through an adhesive on the external surface of the lid or the container of the package.

The package of the invention may be characterized by the presence of at least three degree of child-resistant means.

The above described object and several other objects are intended to be obtained in a further aspect by providing a package characterized by the presence of at least three degree of child-resistant means.

The first degree of child safety may be identified in the high degree of bursting strength and/or compressive strength of the package. This may be referred to also as mechanical child safety.

The second degree of child safety may be identified in the presence of opening means leading to an opening system that physically hinders children from opening the package according to some embodiments of the invention. Thereby the opening of the package is physically impaired to a child, i.e. a child would not be able to open the package of the invention. The correct opening is hampered and/or impeded to a child as the child cannot hold the package in its hands and at the same time press the opening means.

The third degree of child safety may be identified in the fact that the opening means are not intuitive or are counter intuitive. The opening of the package is achievable only upon reading opening instructions thus only a child being able to read instructions is able to understand how to open the package.

A further degree of child safety may be identified in the presence of digital opening means allowing for opening of the package only upon a signal induced by electronic circuits triggered by either a bio signal of the user or by remote signals from an electronic device.

In a further aspect the invention further relates to a method of opening a package comprising at least two opening elements:

holding the package;

exerting a desired degree of pressure to the at least two opening elements.

The at least two opening elements are also referred herein as opening means or pressure means.

In some embodiments the at least two opening elements are more opening elements, allowing for opening upon application of pressure onto the opening elements simultaneously. The opening elements may be located on opposite sides of the package. The opening elements may be identified by determined positions onto the package.

In some embodiments the package may have a cube shape.

In some other embodiments the package may have a parallelepiped shape and the opposite sides are the longest opposite side.

The opening elements may be located on opposite positions that are located on the surface or on the sides of the first and/or second portion that are the most distant from each other.

In some embodiments the at least two opening elements are located on the shortest and opposite sides of the package.

In some other embodiments the at least two opening elements are located on the longest and opposite sides of the package.

The first, second and third and other aspects and embodiments of the present invention may each be combined with any of the other aspects and embodiments.

These and other aspects and embodiments of the invention will be apparent from and elucidated with reference to the embodiments described hereinafter.

BRIEF DESCRIPTION OF THE FIGURES

The package and the methods according to some aspects of the invention will now be described in more detail with regard to the accompanying figures. The figures show one way of implementing the present invention and is not to be construed as being limiting to other possible embodiments falling within the scope of the attached claim set.

DETAILED DESCRIPTION OF AN EMBODIMENT

Figure 1:
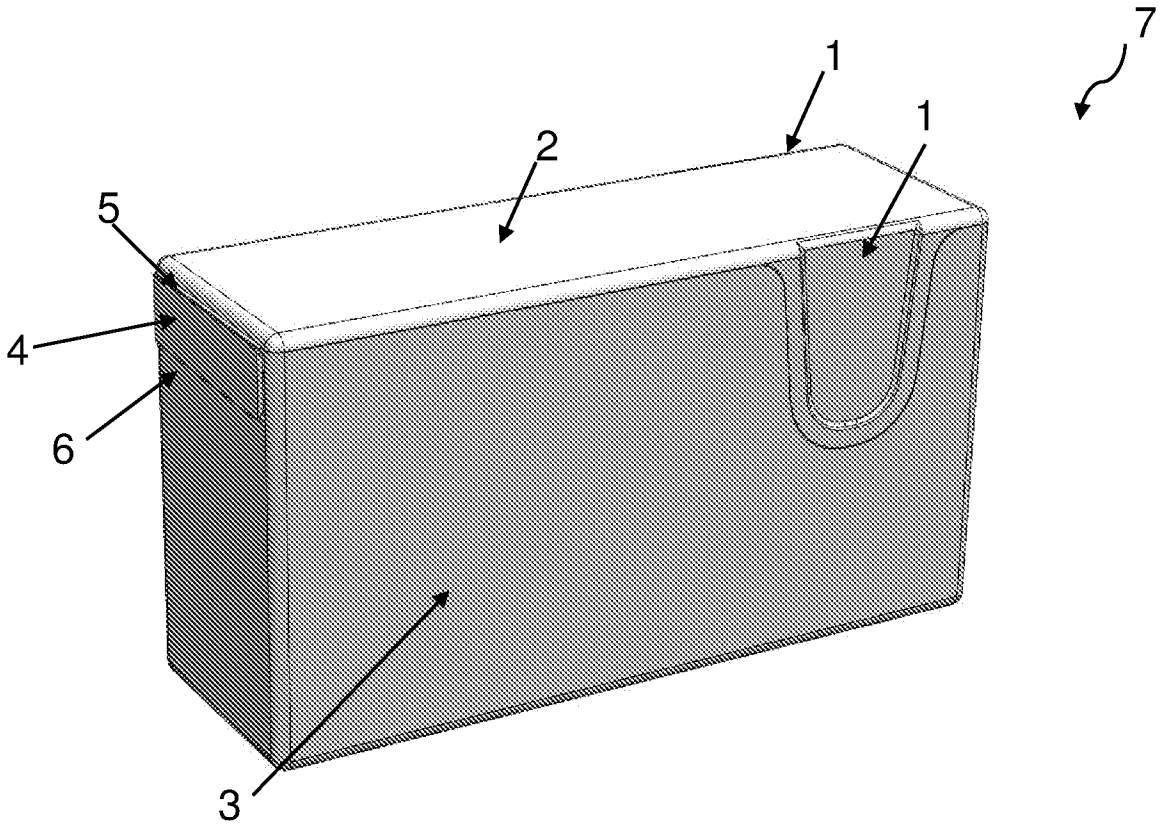
FIG. 1 is a prospective view of the closed package according to some embodiments of the invention.

FIG. 1 is a prospective view of the closed package according to some embodiments of the invention.

FIG. 1 shows a package 7 comprising opening means 1, such as a pressure mean located on both side of the container 3. The opening means 1 in FIG. 1 have the appearance of prolonged buttons that need to be simultaneously pushed so as to open the package. The lid 2 is hinged to the container 3. As shown in FIG. 1 the lid 2 and the container 3 may be produced by injection moulding techniques in a single piece. In some embodiments as shown in FIG. 1 the lid 3 is hingedly connected to a hinge element 4 that is in turn hingedly connected to the container 3. The use of the hinge element 4 allows for an improved degree of rotational freedom as the lid can rotate relative to two axes of rotation, i.e. 5 and 6. At the same time the use of hinge element 4 gives more flexibility to the lid facilitating the use of the means for removing the protecting foil that is located on the lid internal surface.

Figure 2:
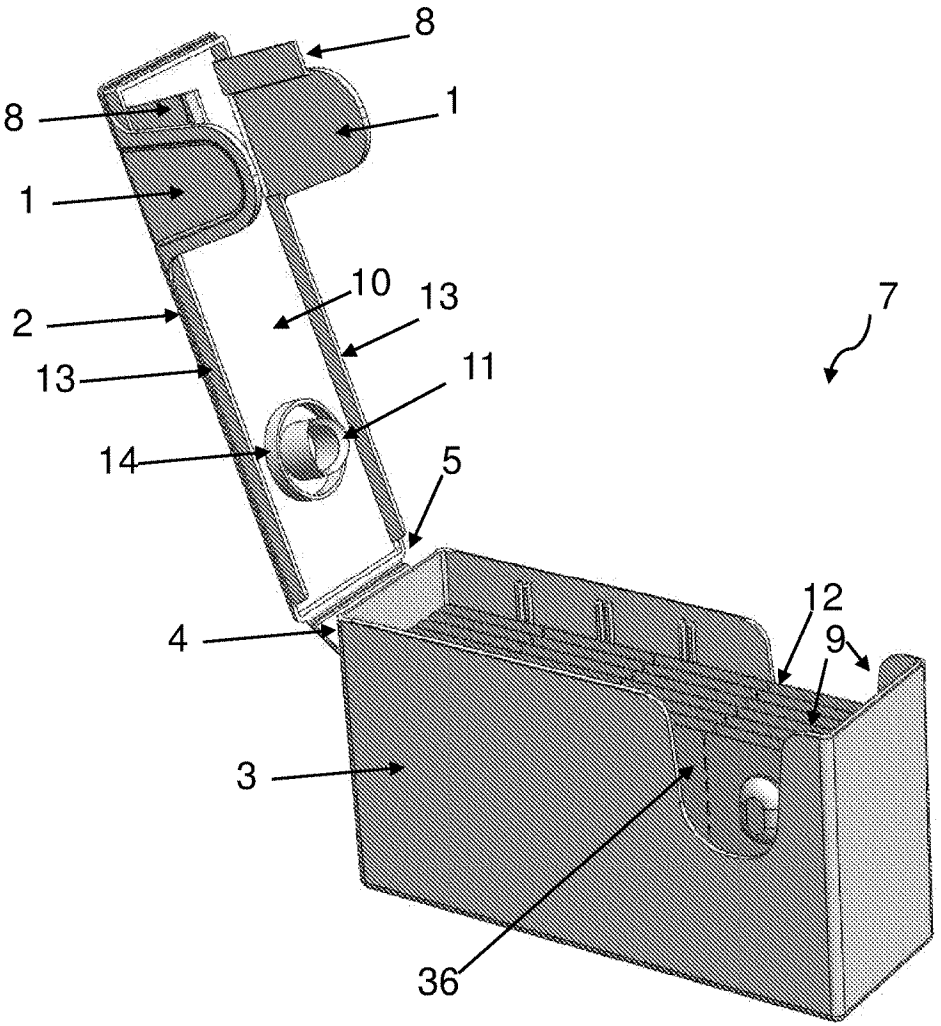
FIG. 2 is a prospective view of the open package according to some embodiments of the invention.

FIG. 2 shows the package 7 when opened. It can be noticed that buttons 1 comprise elements 8 that engage with complementary elements 9 located on the internal wall surface of the container 3. Thus, the means of opening may comprise a snap lock. A protrusion 11, for removing the protective foil of the blister packages 12, is located on the internal surface 10 of the lid 2. The lid may have a wall 13 along its internal edge. In this embodiment a frame 14 surrounding the protrusion 11 may be used so as to facilitate the removal of the protecting foil. The frame 14 has the function of raising the internal surface 10 of the lid at the same or similar level in respect to the level of the wall 13. In this way the removal of the protecting foil is facilitated. In some further embodiments the internal surface of the lid comprises means for raising the internal surface to the level of wall 13, or within 1 to 5 mm from the level of wall 13.

The position of the centre of the protrusion 11 is shown in FIG. 2 at a certain distance from the axis 5. This distance may match the distance between the centre of the last blister of the blister pack and the farthest end, along its width, or the punched line 36, of the blister pack 12 contained in the container 3. This facilitates the use of the lid 2 and the protrusion 11 for removing the protecting foil. Other locations of the protrusion 11 on the lid surface are also possible.

Figure 3:
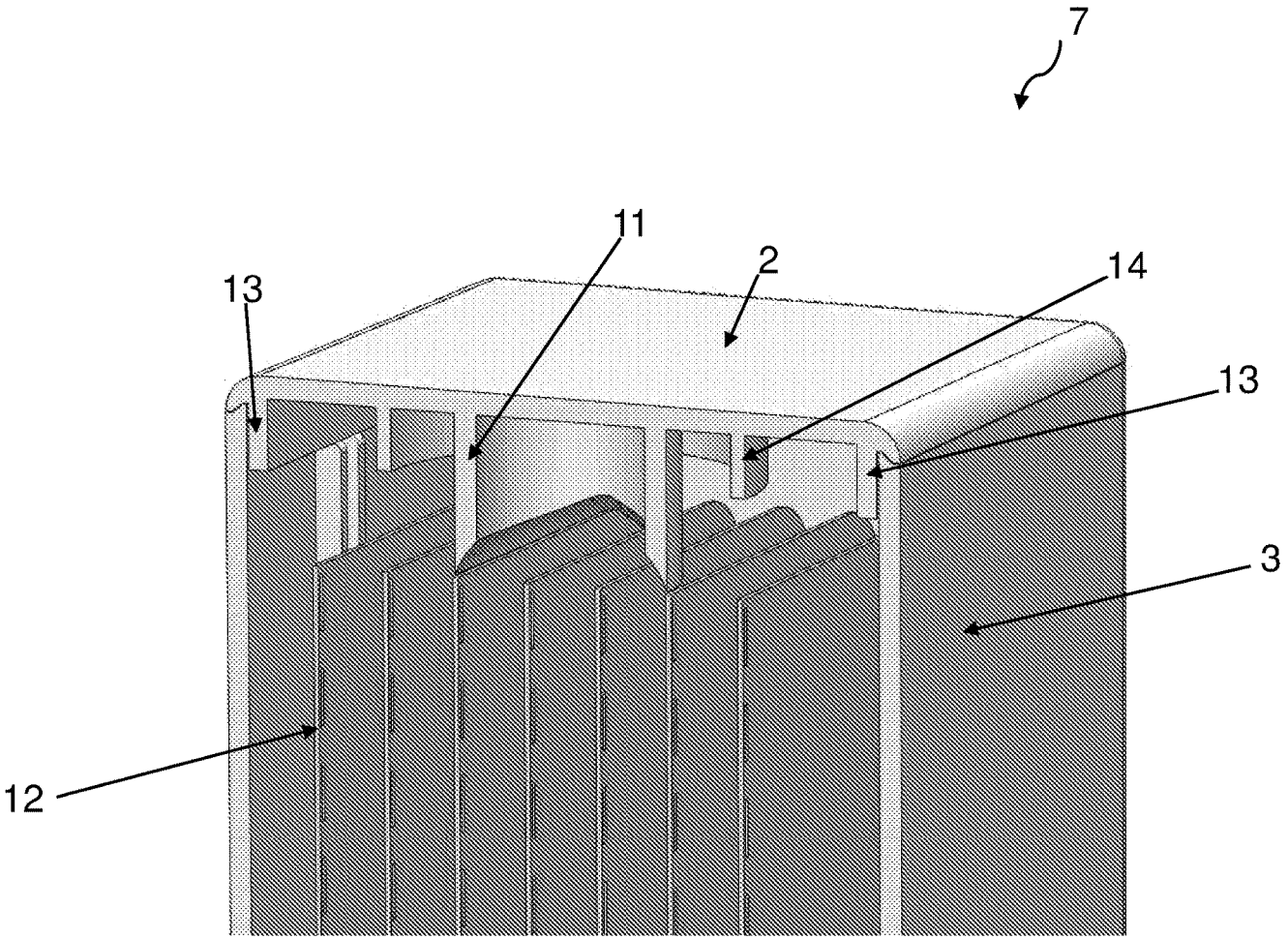
FIG. 3 is a cross section of the closed package of FIG. 1.

FIG. 3 is a cross section of the package 7 when closed. It can be noticed that the means for raising the internal surface, e.g. the frame 14 has a height that is close to, within few millimetres, the height of the wall 13.

Indeed, when the blister pack is positioned onto the protrusion 11 in correspondence of the blister where the protecting foil should be removed, the protecting foil is removed by applying pressure on the blister. By applying pressure the protrusion penetrates in the blister, reaches the tablets therein contained and holds it. The presence of frame 14 facilitate the process as it provides a support for the blister pack at the end of the pressure process as the blister cannot be pushed further since the blister pack surface at the edge of the blister is in contact with the frame and the further pressure exerted, e.g. on the lid causes only the release of the tablet that is hold by the protrusion. In this way, the removal of the protecting foil of the blister is facilitated by the presence of the frame 14 or by other means having the same function. The height of the protrusion 11 may be higher than the depth of the blister cavity.

By holding the tablets in the protrusion the invention has the further advantage of avoiding contamination of the tablets due to the users handling the tablets or due to presence of contaminants on the external surface of the protecting foil.

Figure 4:
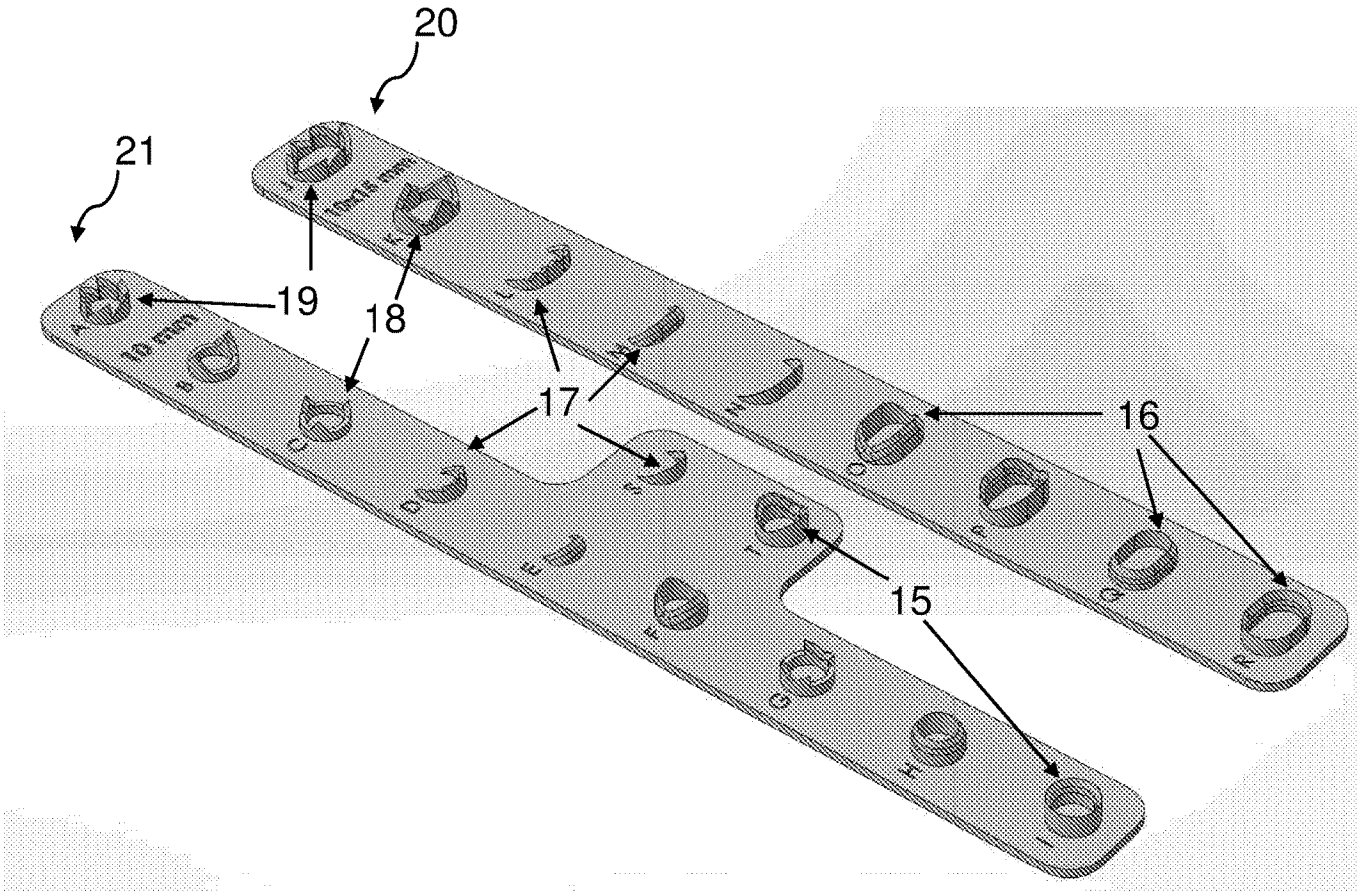
FIG. 4 is a prospective view of examples of means for removing protecting foil according to some embodiments of the invention.

FIG. 4 is a prospective view of examples of means for removing protecting foil according to some embodiments of the invention. For example protrusions may be circular protrusions 15 or oval protrusions 16 depending on the shape of the blisters and of the tablets or capsules to be removed and held. Protrusions may also be half open rim protrusion, such as a half open frame 17, or a closed rim, such as a closed frame 18.

The protrusions may also have at least an indentation 19 so as to provide a better removal of the protecting foil upon applying pressure on the lid or the blister.

The diameter of the protrusions may be in the area between 5 and 20 mm, e.g. 10, 12 or 14 mm. The diameter may be determined by the specific size of the tablet or capsule that has to be removed and held.

In some embodiments more than one protrusions having different shape may be present. The de-blistering tool 20 or 21 comprising one or more protrusions may be included in the container of the package together with blister packs.

Figure 5:
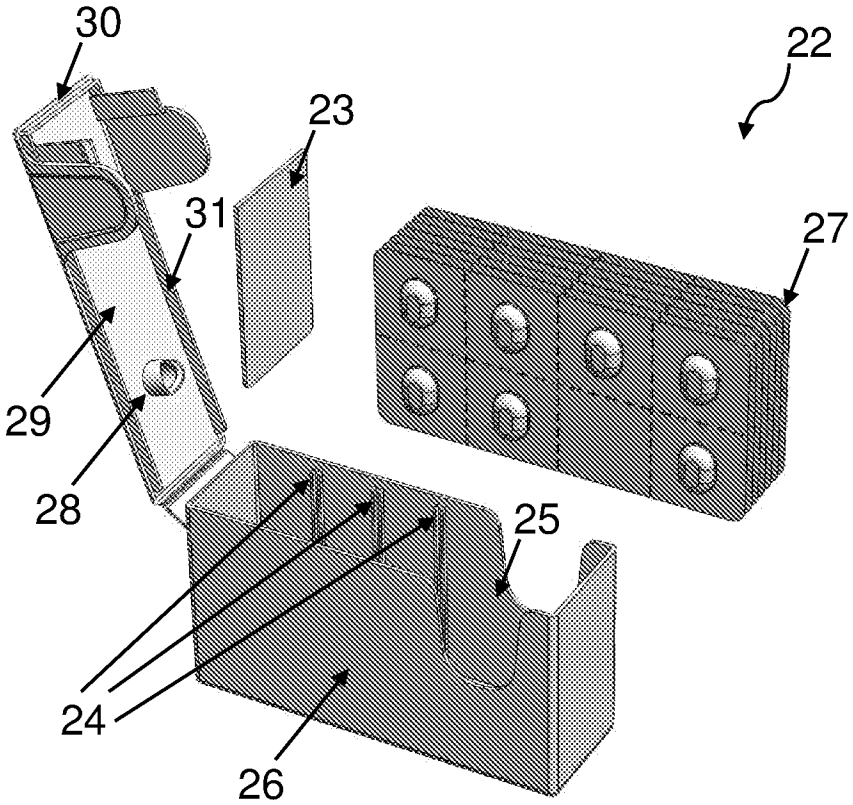
FIG. 5 is a prospective view of the open package according to some other embodiments of the invention.

FIG. 5 is a prospective view of the open package 22 according to some other embodiments of the invention. Package 22 is characterized by the presence of at least one separator walls 23 that can be inserted into dedicated slides 24 on the internal wall 25 of the container 26. The wall reduces the internal length of the container 26 so that blister packages 27, having a length shorter than the length of the container 26 can better be accommodated into the container. In this way the transport of the blister package is safer as the blister packages 27 are not moving inside the container 26.

Package 22 has also a protrusion 28 on the internal surface 29 of the lid 30. As it can be clearly seen from FIG. 6 the package 22 has a protrusion 28 having a height higher than the wall 31 and does not have a frame surrounding the protrusion 28.

Figure 6:
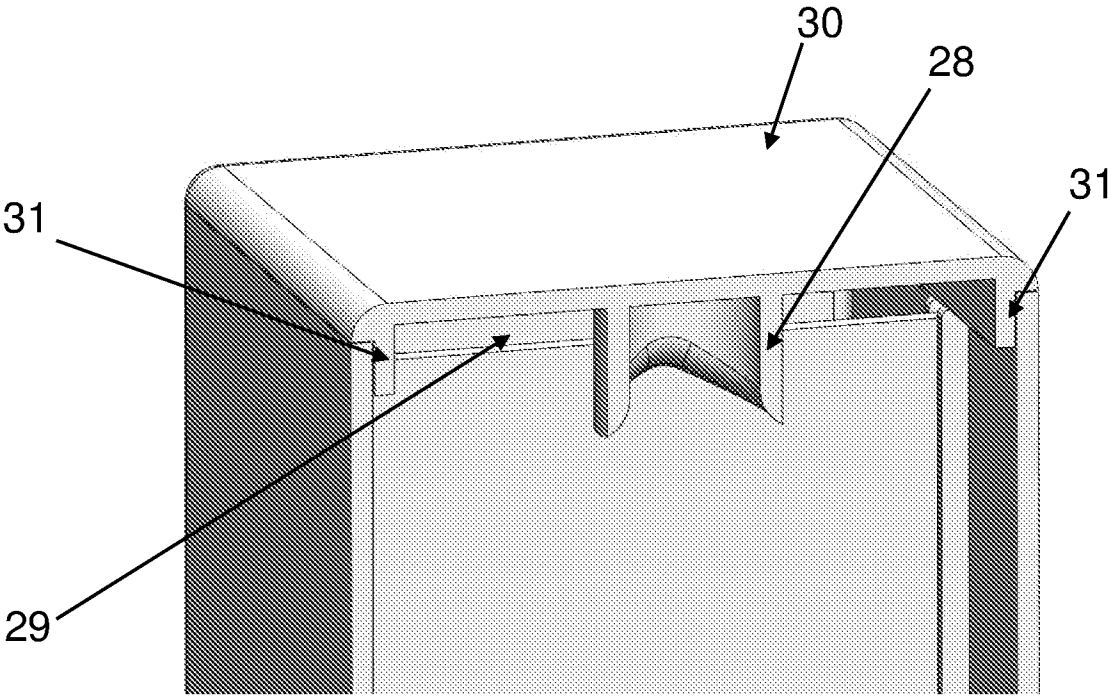
FIG. 6 is a cross section of the package of FIG. 5 when closed.

FIG. 6 is a cross section of the package of FIG. 5 when closed.

Figure 7:
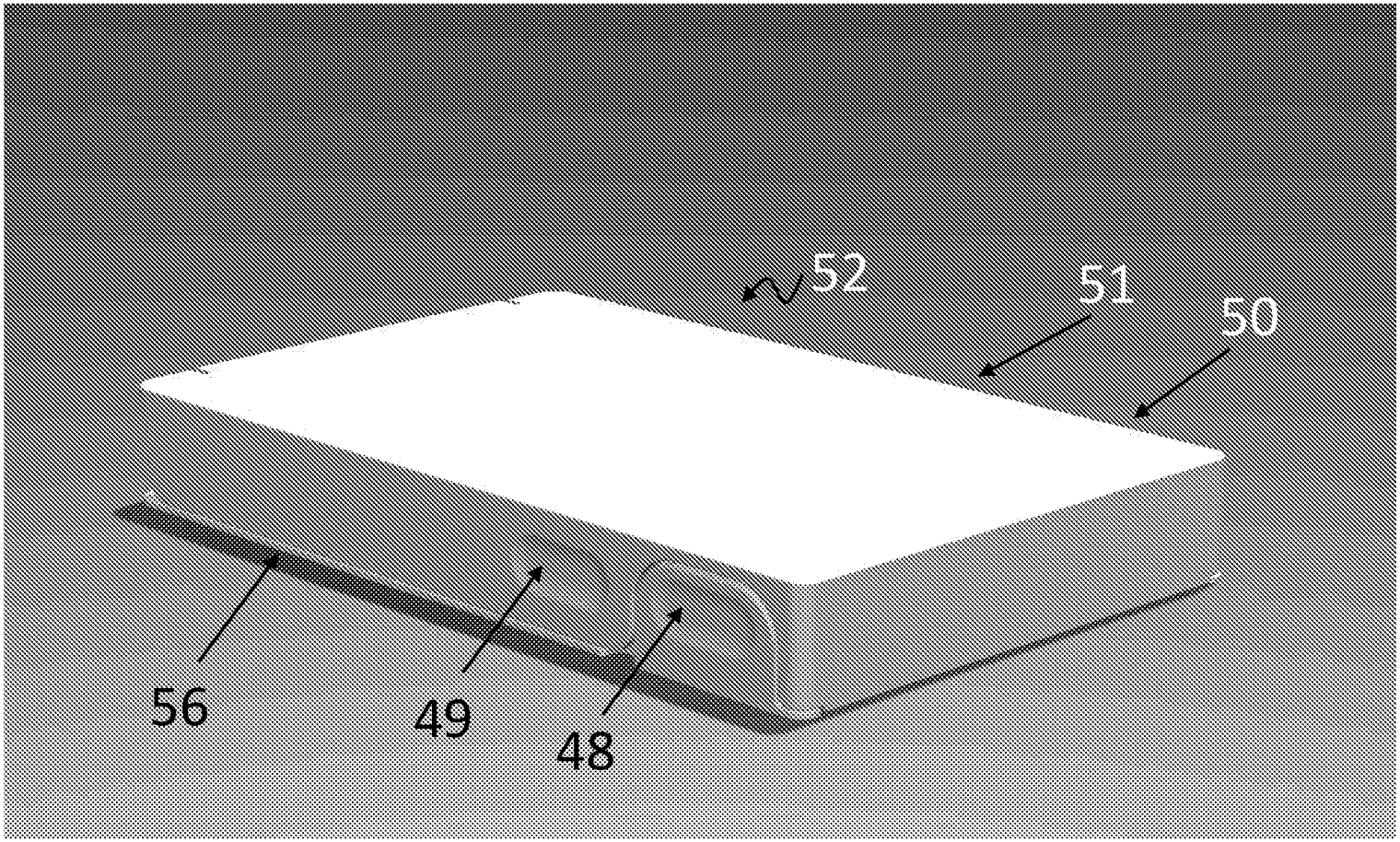
FIGS. 7, 8 and 9 show schematically 3-dimensional views of a medical package according to some embodiments of the invention, in its closed and opened state showing the locking mechanism according to some embodiments of the invention.

FIG. 7 shows schematically a 3-dimensional view of a medical package according to another embodiment of the invention in its closed state. Two pairs of gripping elements 48, 49 and 50,51 are shown locate on the longest and opposite side of the medical package 52.

The pairs 50, 51 cannot be seen due to the orientation of the 3-dimensional view, however they resemble the pair 48, 49.

Figure 8:
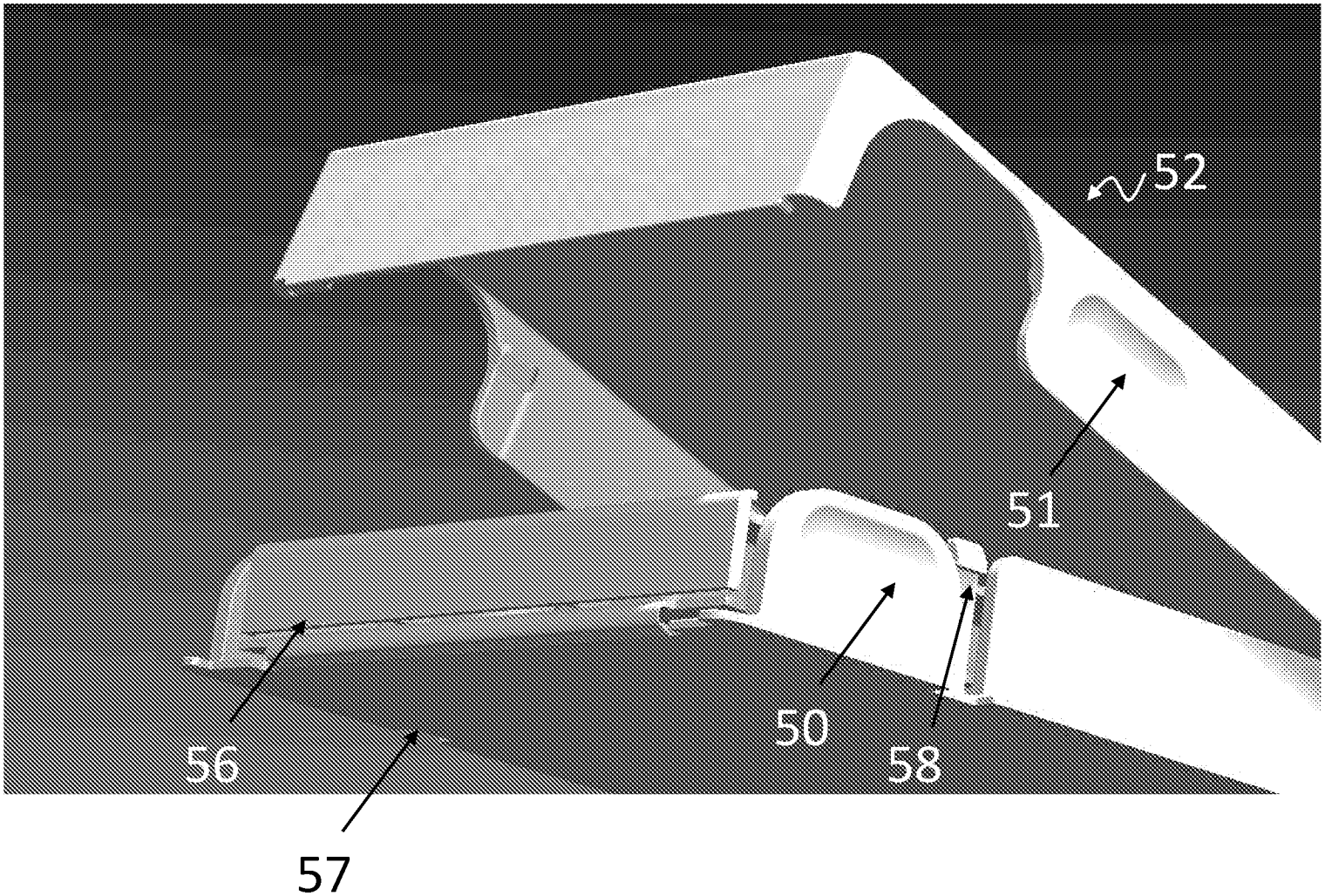
Figure 9:
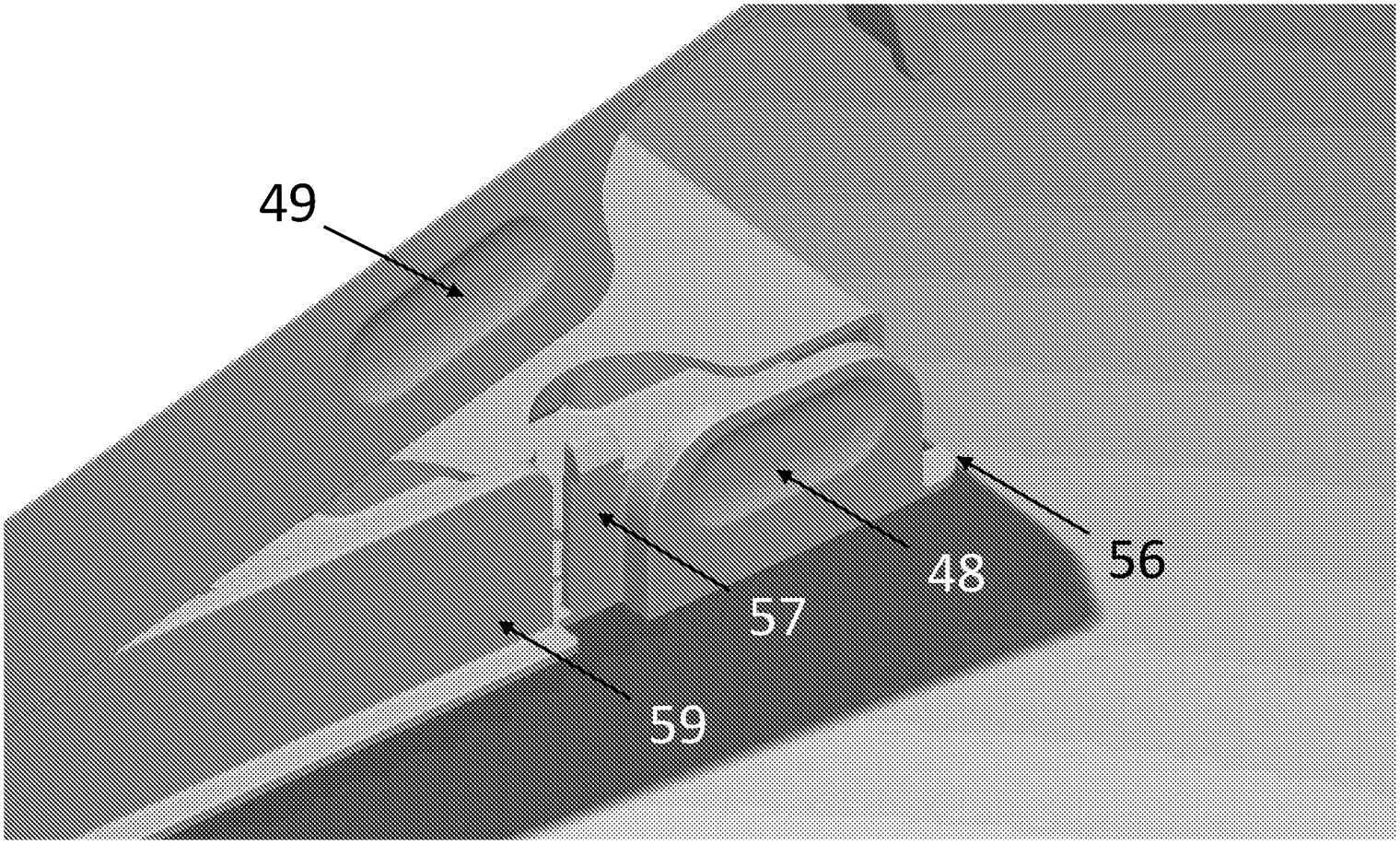

However, even if resembling each other, the two gripping elements of the pairs 48, 49 and 50, 51 have different functions. Gripping element 48 and 50 are opening elements. In order to open the medical package 52 and adult hand has to apply pressure on both opening elements 48 and 50 so as to distort the first portion 56 allowing the hidden latches 57 and 58 to be released. Hidden latches 57 and 58 may be located underneath the opening elements 48 and 50, therefore applying pressure on the opening elements 48 and 50 may allow the release latches 57 and 58 without distortion in the structure of the portion 56. In order to complete the opening following the release of the hidden latches 57 and 58, an adult hand should grip the gripping elements 49 and 51 so as to open the medical package 52 as shown in FIGS. 8 and 9. The opening elements 18 and 20 may comprise the latches 57 and 58 as shown in FIG. 9. Thus, opening may also be achieved by minimum distortion of the structure of the opening elements 48 and 50. The opening elements 48 and 50 may be comprised in the rim 59 of the carrier portion 56.

The shape and/or appearance of the pairs of gripping elements 18, 19 and 20, 21 is advantageously the same. If not instructed, a user, or a child approaching the medical package would not be able to distinguish the different functions of the gripping elements as they have the same appearance. A child thus may be tempted to grip all the elements thus hindering the release of the hidden latches.

Figure 10:
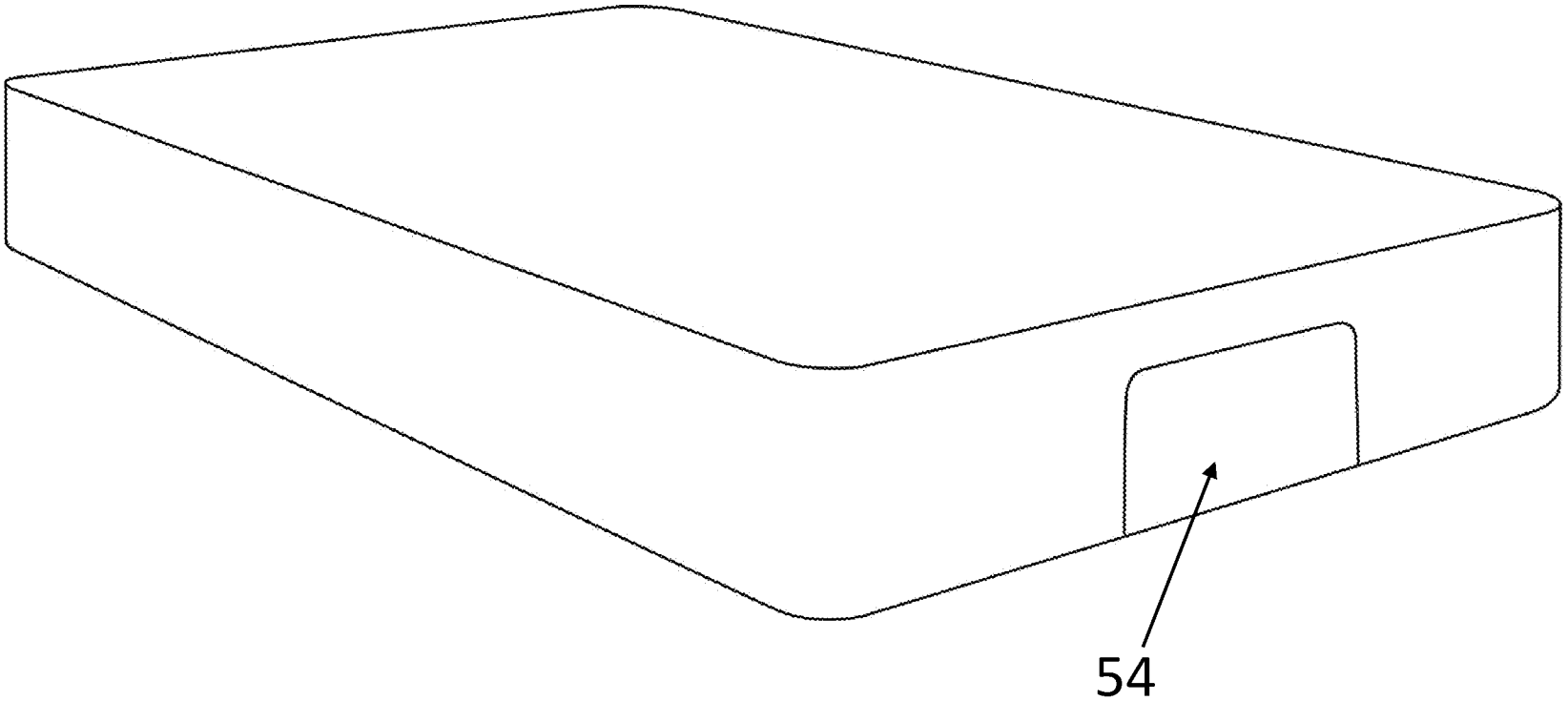
FIGS. 10 and 11 show schematically 3-dimensional views of a medical package in its closed state having two means for opening located on the shortest and opposite sides of the medical package according to one embodiment of the invention.
Figure 11:
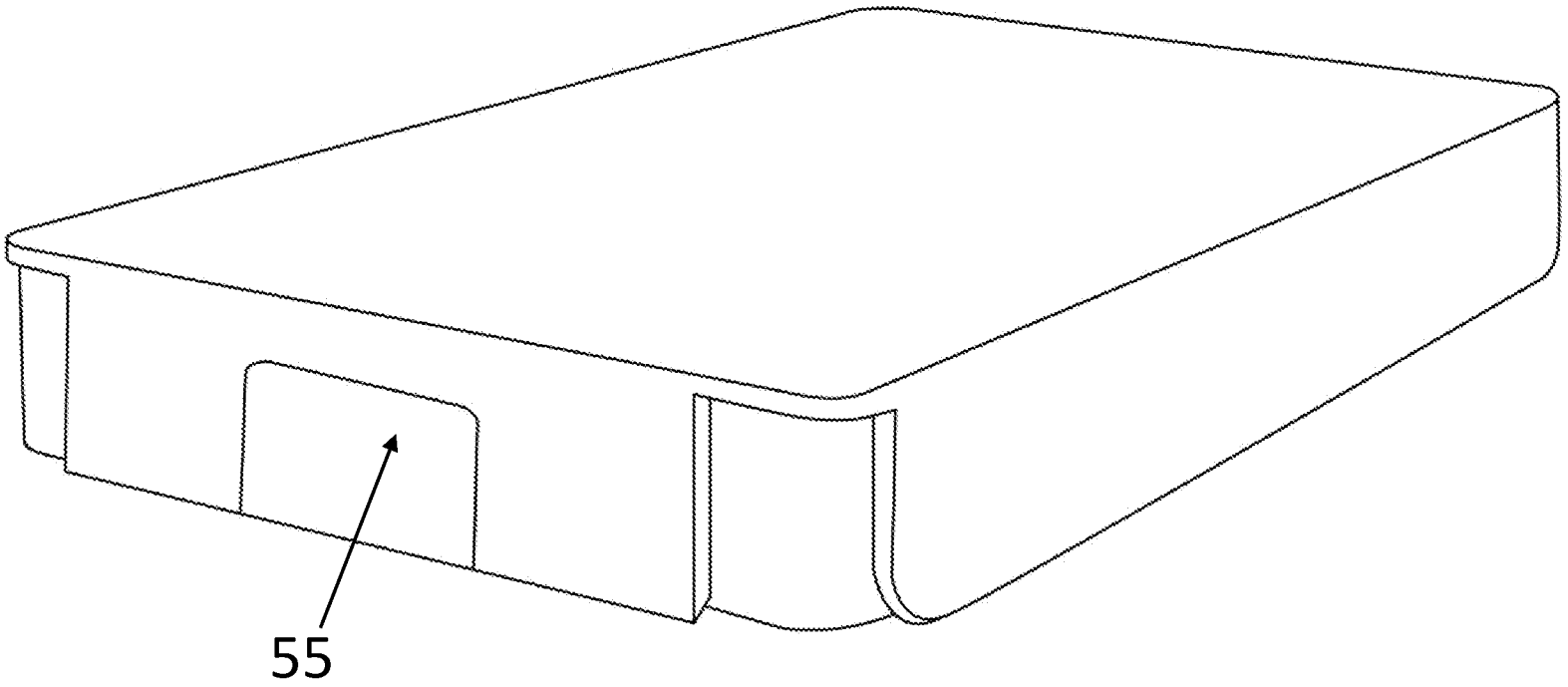

FIGS. 10 and 11 show schematically 3-dimensional views of a medical package in its closed state having a pair of opening elements 54 and 55 located on the shortest and opposite sides of the medical package according to some embodiments of the invention.

In this way a higher level of child safety is achieved as a child hand cannot simultaneously exert pressure on both opening elements located at a distance that is longer than the distance between the child thumb and one of the child four fingers when opened.

Figure 12:
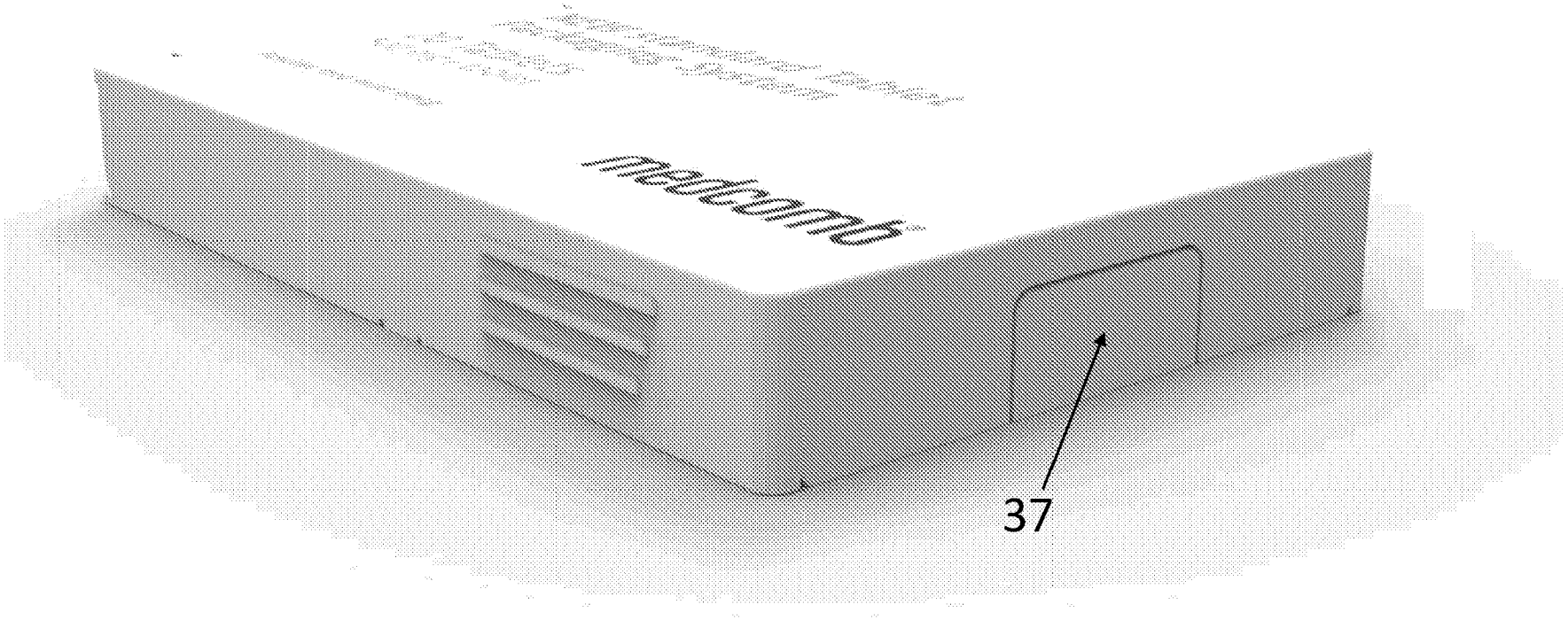
FIGS. 12, 13 and 14 show schematically 3-dimensional views of a medical package in its closed state where the correspondent two means for opening have different shapes according to some embodiments of the invention.
Figure 13:
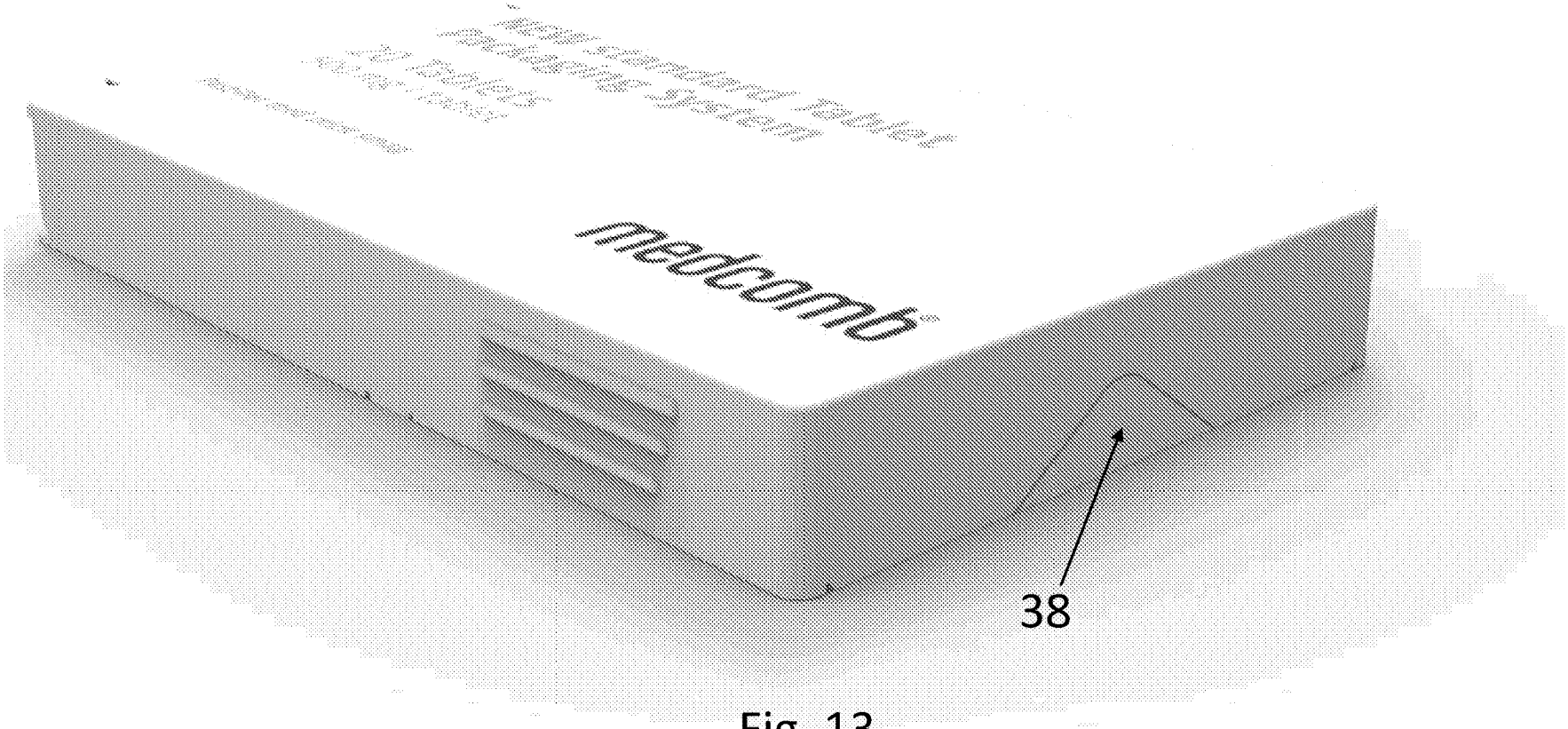
Figure 14:
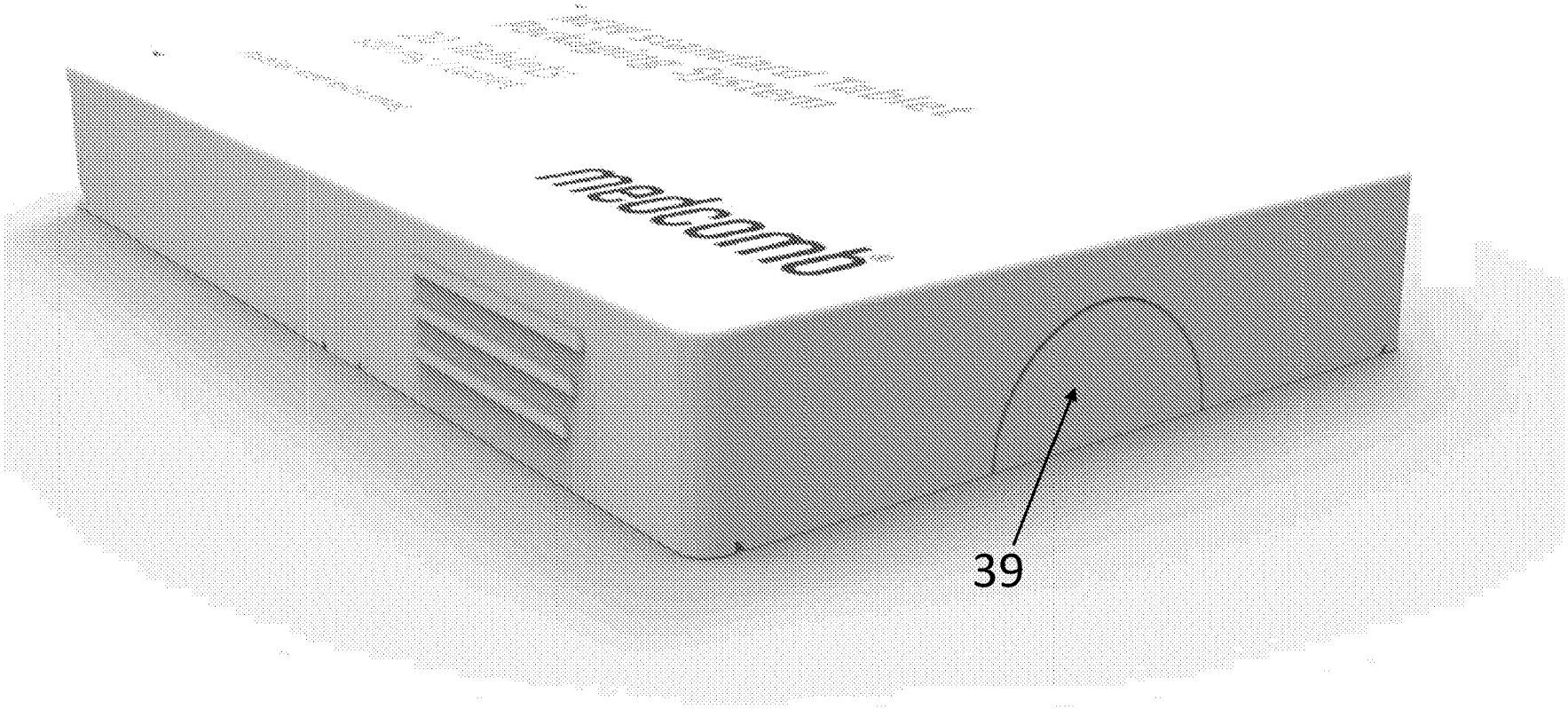

FIGS. 12, 13 and 14 show schematically 3-dimensional views of a medical package in its closed state where the correspondent pairs of opening elements 37, 38 and 39 have different shapes according to some embodiments of the invention.

The shapes may be misleading as counterintuitive towards the correct opening of the medical package.

Figure 15:
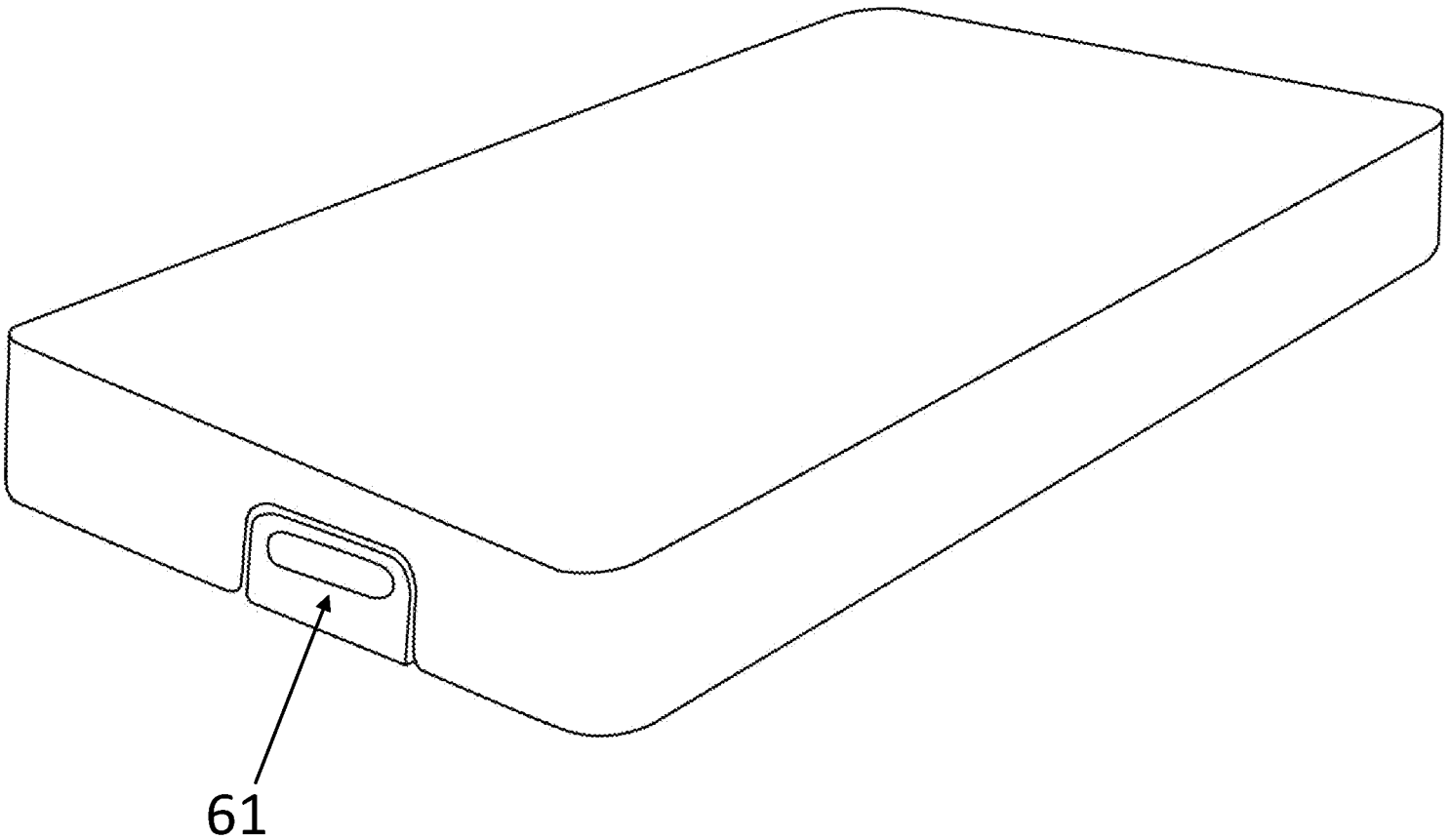
FIGS. 15 and 16 show schematically 3-dimensional views of a medical package in its closed state and half-opened state according to some embodiments of the invention.
Figure 16:
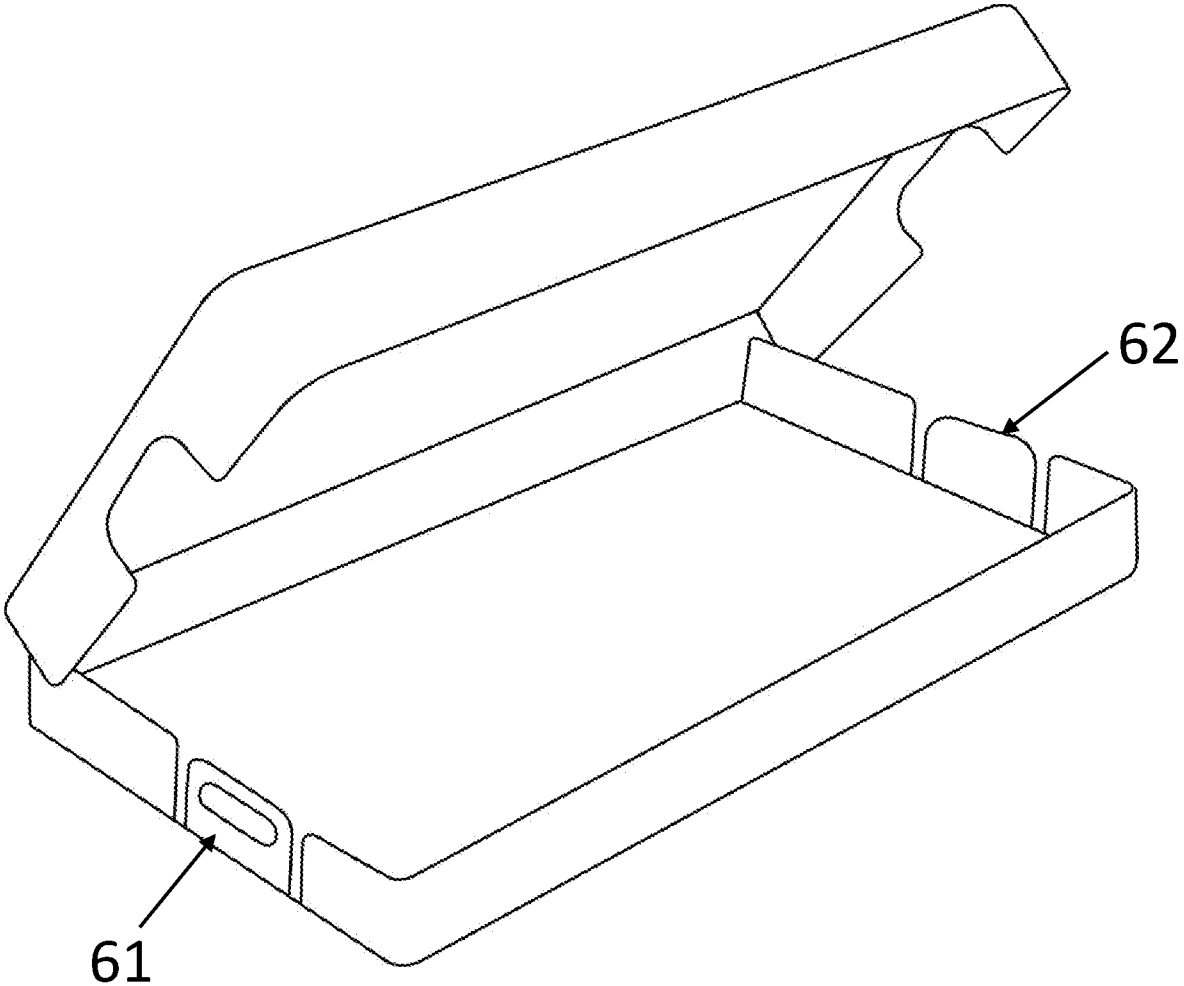

FIGS. 15 and 16 show schematically 3-dimensional views of a medical package in its closed state and while opening according to some embodiments of the invention.

Upon applying pressure on the opening elements 61 and 62 the medical package is unlocked and can be opened.

The medical package showed in the previous figures may follow the same opening steps as shown in FIG. 16.

Figure 17:
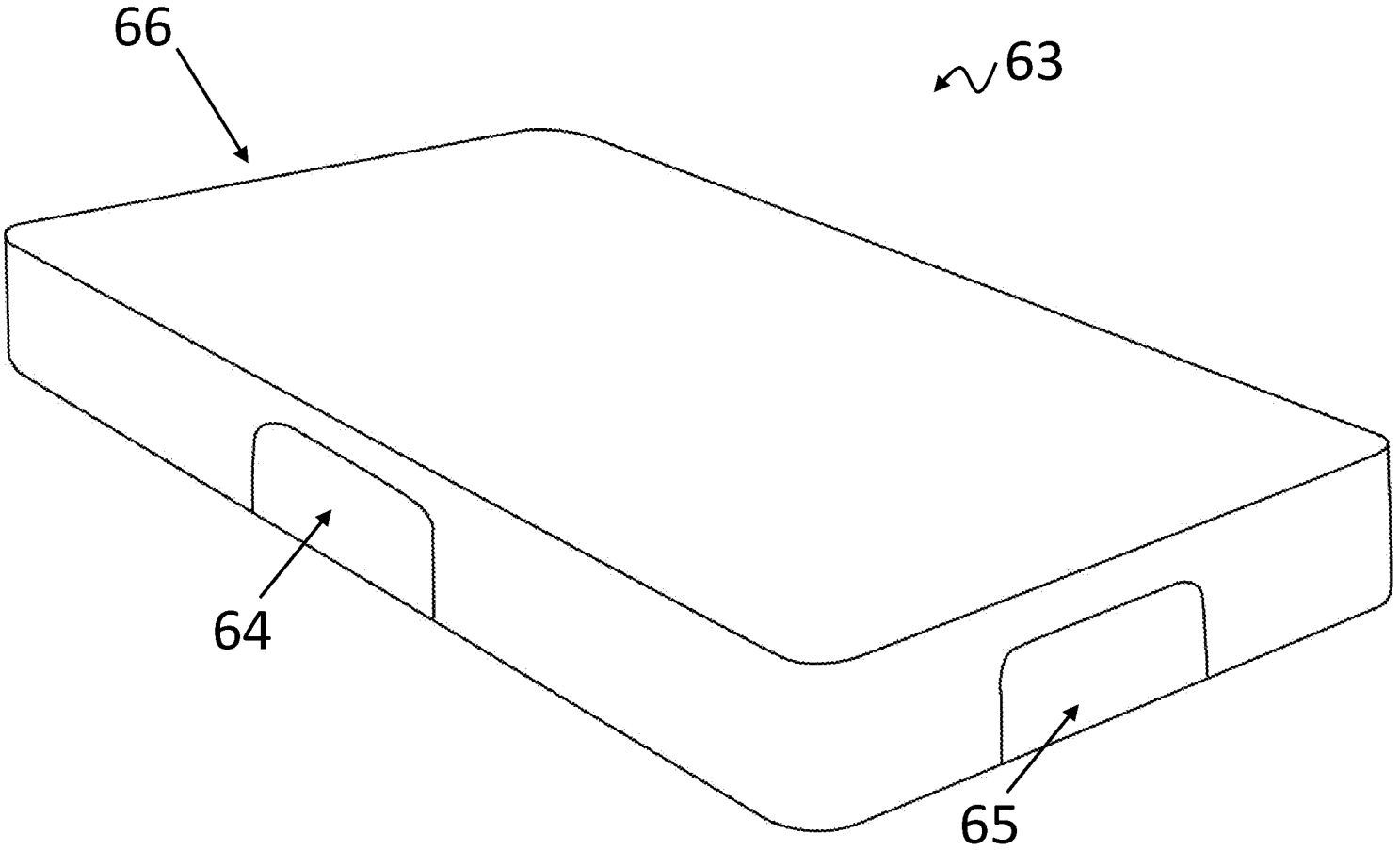
FIG. 17 show schematically a 3-dimensional view of a medical package having more than two means for opening according to some embodiments of the invention.

FIG. 17 shows schematically a 3-dimensional view of a medical package having more than two means for opening according to some embodiments of the invention. For example the package 63 has three opening elements 64, 65 and 66.

In some embodiments two or more finger-actuated latches or tool-actuated latches may be released in a certain sequence so as to allow opening of the medical package. It may be that two or more sets of latches may have to be released in a certain sequence so as to allow opening, thus requiring two adult hands to actuate the two or more set of latches.

Figure 18:
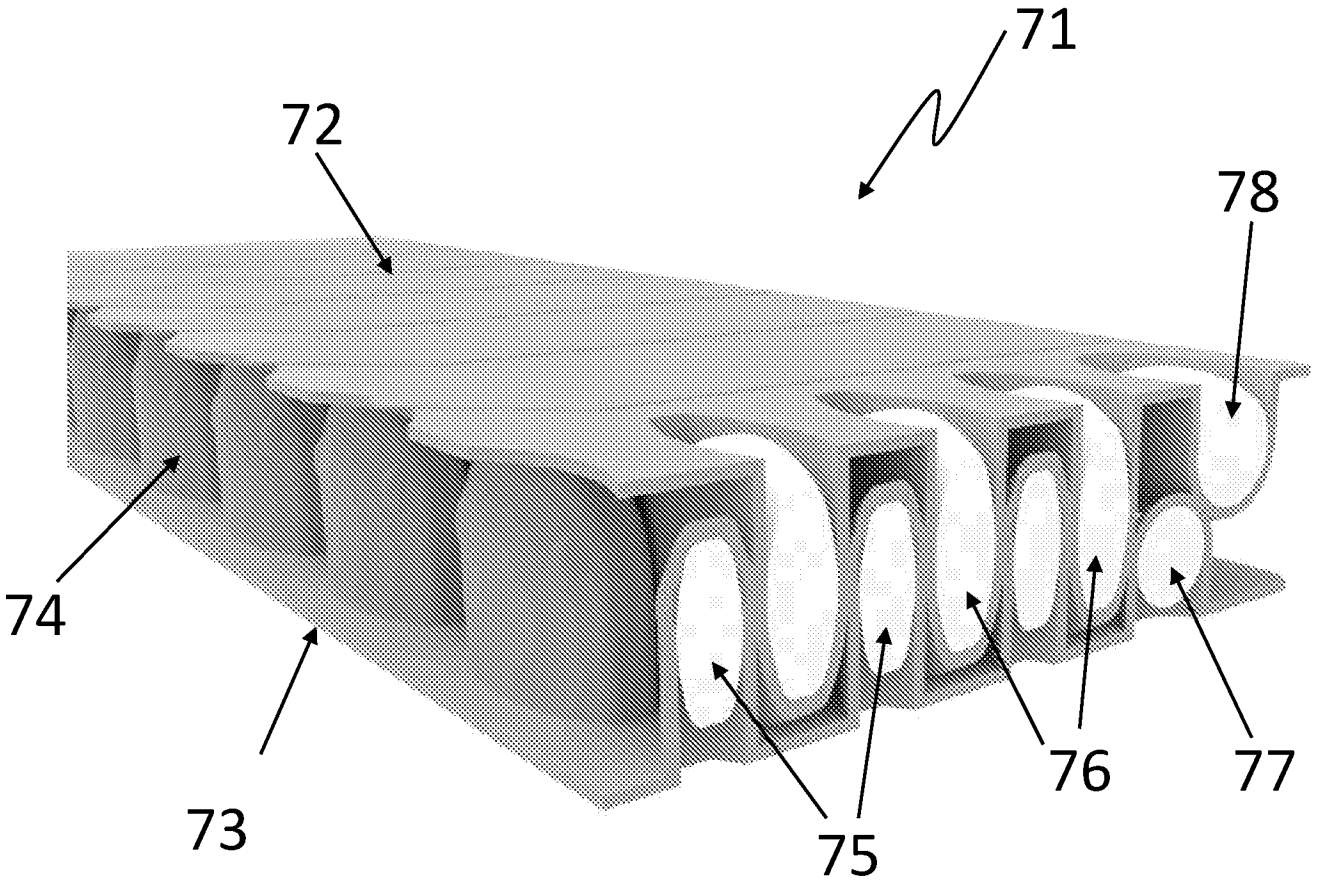
FIG. 18 shows a medical package which comprises different shapes and sizes of blisters.

FIG. 18 shows a blister pack 71 which comprises different shapes and sizes of blisters in a partly cut-through view. Such a blister pack 71 can be used in combination with the overall inventive idea of the present invention or it may be used in another packaging adapted to contain the blister pack as an insert. It may also be used without any further enclosing packaging. It will typically comprise a foil covering and protecting the content of the blisters. Such a foil may be adapted to be removed from one or more blister openings at a time to provide access to the content. This is shown more clearly in FIG. 20. The blister pack may e.g. be used for different types of medicine that can then easily be provided and carried around in one package. It may alternatively or in combination therewith be used for supplements, such as those mentioned above. Such supplements may e.g. in solid or liquid form; they may also be a freeze-dried substance. The material used for the blisters as well as any foil covering the blisters should be chosen in accordance with how the content of the blisters may react with the surroundings.

It may e.g. have to be a material that is moisture impermeable at the temperatures and pressures that the packaging may experience. The blister pack 71 shown in FIG. 18 is formed by an upper part 72 and a lower part 73, where "upper" and "lower" refers to the orientation shown in the figure. In use the pack may be turned in any direction, such as upside-down compared to the one shown.

The upper and lower parts 72,73 each contain an array of blisters which are arranged so that when the blister pack 71 is in a folded configuration as the one shown in FIG. 18, the blisters 74 of the upper part 72 intermesh with the blisters 74 of the lower part 73. In a preferred embodiment, the blisters intermesh in a way so that they support each other without deforming or damaging each other when the pack is folded into engagement. These blisters of the upper and lower parts 72,73 may interlock or press fit, e.g. male-female lock upon folding and/or pressing together the parts. An interference fit, also referred to as a press fit, provides fastening between the blisters when they are pushed into contact.

In the embodiment shown in FIG. 18, the upper part 72 contains two different shapes and sizes of blisters marked as 76 and 78, and the lower part 73 contains to other shapes and sizes of blisters marked as 75 and 77. In embodiments intended for storing more types of medicine and/or supplements that are to be taken at the same time, it will be appropriate to cover these with one separable piece of cover foil.

When the embodiment in FIG. 18 is used in combination with a package comprising means for removing the protective foil covering the blisters as described above, the means may have a plurality of protrusion 15,16 e.g. such as those shown in FIG. 4. The shapes and sizes of these protrusions 15,16 should then be matched to the actual blisters in the blister pack 71.

Figure 19:
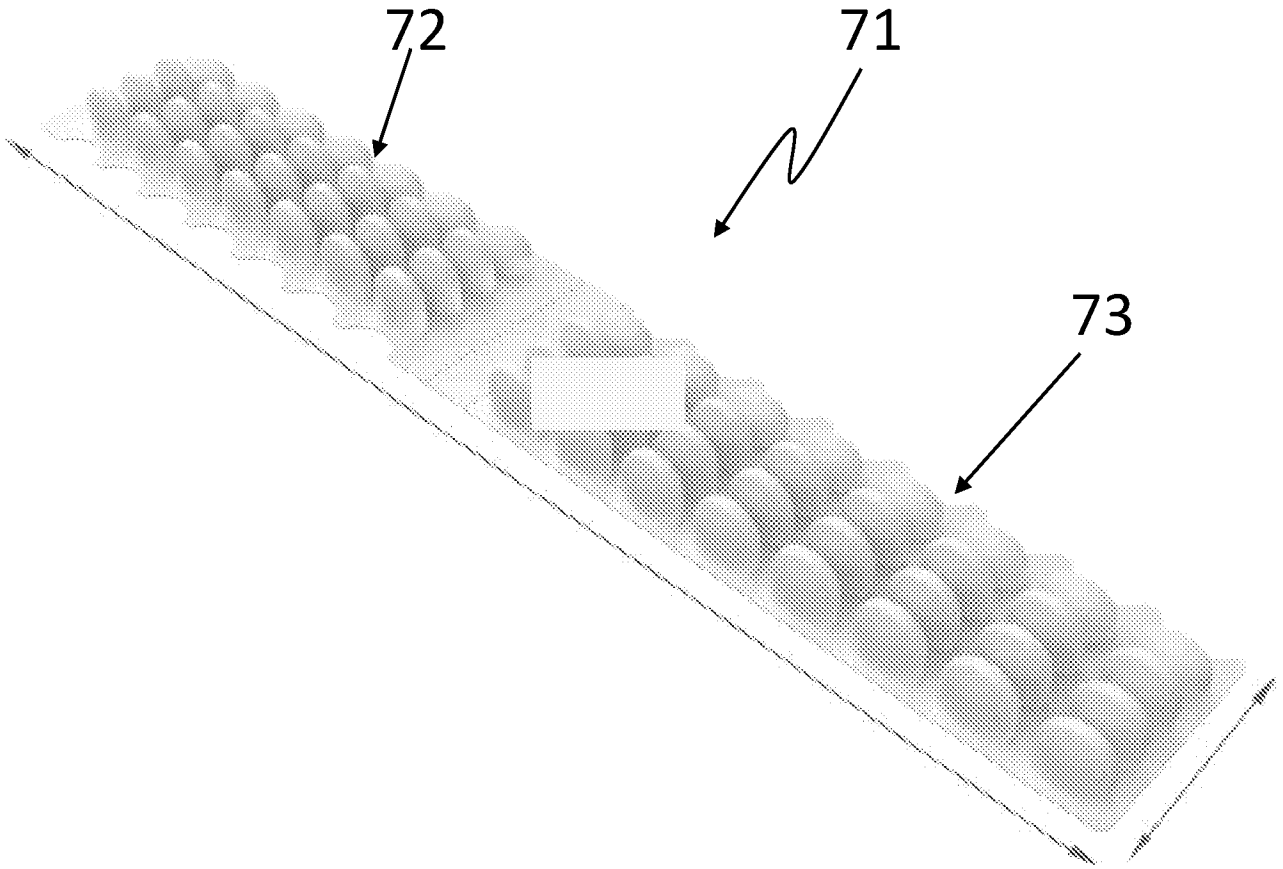
FIG. 19 shows an unfolded medical package having different sizes of blisters on the two parts.

FIG. 19 shows an unfolded medical package having different sizes of blisters on the two parts which are referred to as upper part 72 and lower part 73 in relation to FIG. 18. In the embodiment in FIG. 19, each part has one size of blisters.

Figure 20:
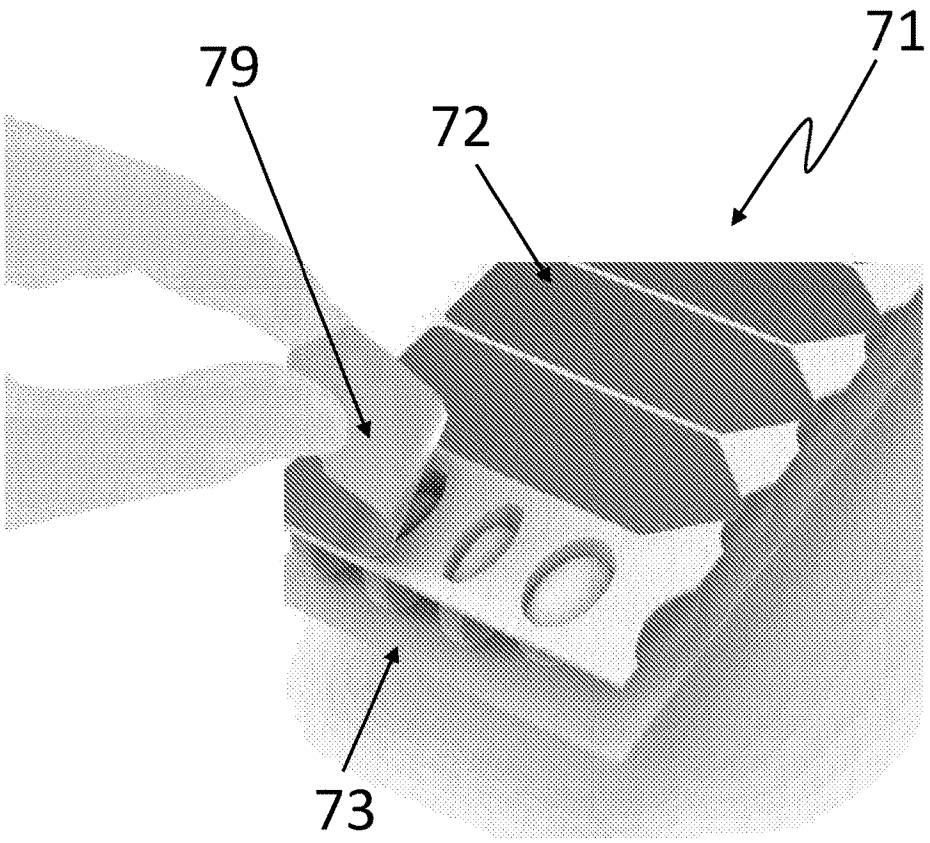
FIG. 20 shows a medical package having covering foils each covering a plurality of blisters.

FIG. 20 shows a medical package having covering foils 79 each covering a plurality of blisters. Hereby it is easy e.g. to gain access to a plurality of medicine and/or supplements to be taken at a given time as explained in relation to FIG. 18.

Figure 21:
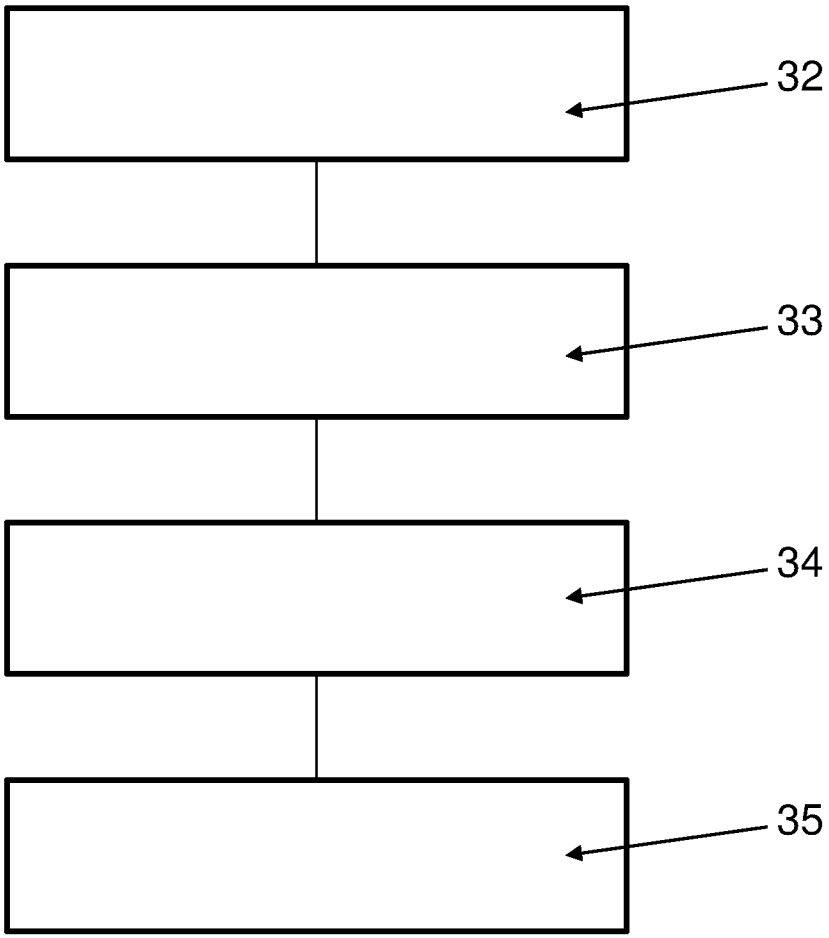
FIG. 21 is a flow-chart of the method of opening a blister pack according to one aspect of the invention.

FIG. 21 is a flow-chart of the method of opening a blister pack according to one aspect of the invention. The method of opening a pharmaceutical blister pack comprised in a package comprises: opening 32, the package; removing 33, the pharmaceutical blister pack; contacting 34 the protrusion to the protecting foil covering a blister of the pharmaceutical blister pack; exerting 35 a pressure on the blister thereby removing the foil in correspondence of the blister.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A package comprising:

at least one pharmaceutical blister pack that comprises blisters and a protecting foil, wherein said at least one pharmaceutical blister pack comprises pharmaceutical compositions within said blisters, said pharmaceutical compositions being in the form of tablets;

a protrusion that extends out of a surface of said package, wherein said protrusion is configured to hold a tablet and, when in use, remove the protecting foil, wherein said protrusion has a radial extent smaller than a blister of said at least one blister pack contained in said package, wherein said package is configured such that said protecting foil is removable by applying pressure on a blister when said at least one pharmaceutical blister pack is positioned onto the protrusion in correspondence to said blister and as said protrusion penetrates in said blister, the protrusion reaches a tablet therein contained and holds said tablet; and a lid having a wall along an internal edge, wherein said lid further comprises a frame in the shape of a ring extending out of an inner surface of the lid and surrounding said protrusion, said frame being configured to contact a surface of said at least one pharmaceutical blister pack at an edge of said blister when pressure is applied on said blister when said at least one pharmaceutical blister pack is positioned onto the protrusion in correspondence to said blister to facilitate removal of said protecting foil;

wherein the protrusion is attached to the lid and extends out of the inner surface of the lid.

2. The package according to claim 1, wherein said protrusion has a radial extent larger than or equal to said tablets contained in said blisters.

3. The package according to claim 1, wherein said protrusion has a height that is higher than the depth of the blister cavity.

4. The package according to claim 1, wherein said package comprises a container that comprises an internal and external surface.

5. The package according to claim 4, wherein said protrusion is located on said internal surface of said container.

6. The package according to claim 1, wherein said protrusion is a circular protrusion.

7. The package according to claim 1, wherein said protrusion comprises at least an indentation.

8. The package according to claim 4, further comprising said at least one pharmaceutical blister pack contained inside said container.

9. The package according to claim 4, wherein said container comprises said lid.

10. The package according to claim 1, wherein said frame has a height that is within few millimetres of the height of a wall along the internal edge of said lid.

11. The package according to claim 1, wherein said protrusion comprises a lateral and a vertical extent and said lateral extent is larger than said vertical extent.

12. The package according to claim 1, wherein said protrusion is a single continuous protrusion.

13. The package according to claim 1, wherein said protrusion is fastened to or included in said container.

14. The package according to claim 1, wherein said package is a tamper proof package.

15. The package according to claim 1, wherein said package is a child resistant package.

* * * * *